US010283048B2

(12) United States Patent
Tsuchida

(10) Patent No.: US 10,283,048 B2
(45) Date of Patent: May 7, 2019

(54) DISPLAY DEVICE, DISPLAY DEVICE CORRECTION METHOD, DISPLAY DEVICE MANUFACTURING METHOD, AND DISPLAY DEVICE DISPLAY METHOD

(71) Applicant: JOLED INC., Tokyo (JP)

(72) Inventor: Shinya Tsuchida, Tokyo (JP)

(73) Assignee: JOLED INC., Tokyo (JP)

( * ) Notice: Subject to any disclaimer, the term of this patent is extended or adjusted under 35 U.S.C. 154(b) by 52 days.

(21) Appl. No.: 15/790,591

(22) Filed: Oct. 23, 2017

(65) Prior Publication Data

US 2018/0122299 A1 May 3, 2018

(30) Foreign Application Priority Data

Oct. 28, 2016 (JP) ..... 2016-212350

(51) Int. Cl.
*G09G 3/20* (2006.01)
*G09G 3/3233* (2016.01)

(52) U.S. Cl.
CPC ..... *G09G 3/3233* (2013.01); *G09G 3/2059* (2013.01); *G09G 2300/0842* (2013.01);
(Continued)

(58) Field of Classification Search
CPC ..... G09G 3/3233; G09G 3/2059; G09G 2300/0842; G09G 2320/0233;
(Continued)

(56) References Cited

U.S. PATENT DOCUMENTS 6,011,878 A * 1/2000 Ushida ..... G06T 3/40 358/3.1
8,229,212 B2 * 7/2012 Siddiqui ..... G06T 3/4015 382/162

(Continued)

FOREIGN PATENT DOCUMENTS

WO 2011/118124 9/2011

*Primary Examiner* — Amare Mengistu
*Assistant Examiner* — Crystal Mathews
(74) *Attorney, Agent, or Firm* — Greenblum & Bernstein, P.L.C.

(57) ABSTRACT

A display device correction method includes: obtaining, in advance, first correction data for correcting a luminance signal; performing a first transform including applying an error diffusion method to the first correction data to transform the first correction data into second correction data; performing a second transform including thinning, via a predetermined thinning method, the second correction data by removing at least one but not all of the correction data components to transform the second correction data into third correction data; performing a third transform including interpolation, via a predetermined interpolation method, using pixel data components included in the third correction data, to transform the third correction data into fourth correction data; and correcting the luminance signal using the fourth correction data. In the first transform, based on the predetermined thinning method and interpolation method, the transform is performed such that the second correction data matches the fourth correction data.

9 Claims, 19 Drawing Sheets

(52) U.S. Cl.
CPC ..... *G09G 2320/0233* (2013.01); *G09G 2320/0285* (2013.01); *G09G 2320/0626* (2013.01); *G09G 2360/16* (2013.01)

(58) Field of Classification Search
CPC ... G09G 2320/0276; G09G 2320/0285; G09G 2320/0626; G09G 2360/16
See application file for complete search history.

(56) References Cited

U.S. PATENT DOCUMENTS

2003/0067616 A1* 4/2003 Toyoda ..... G09G 3/3611 358/1.9
2006/0028687 A1* 2/2006 Karaki ..... G06F 3/1446 358/3.01
2007/0070085 A1* 3/2007 Yamagata ..... G09G 3/20 345/606
2007/0109321 A1* 5/2007 Yu ..... G09G 3/2059 345/616
2011/0013202 A1* 1/2011 Muramatsu ..... G03G 15/5062 358/1.2
2012/0106835 A1* 5/2012 Bernal ..... H04N 1/4052 382/162
2013/0021389 A1* 1/2013 Odawara ..... G09G 3/3233 345/690
2013/0215326 A1* 8/2013 Sato ..... G09G 3/2025 348/453
2013/0257887 A1* 10/2013 Xu ..... G09G 5/10 345/589
2014/0016880 A1* 1/2014 Kerofsky ..... G06T 5/008 382/274
2016/0019846 A1* 1/2016 Kim ..... G09G 3/3406 345/690
2016/0196777 A1* 7/2016 Liu ..... G09G 3/2003 345/694

* cited by examiner

FIG. 5A

| | | | | | | | |
|---|---|---|---|---|---|---|---|
| 1.1090 | 1.1427 | 1.0893 | 1.1033 | 1.1230 | 1.1314 | 1.1146 | ... |
| 1.0668 | 1.0753 | 1.0640 | 1.0584 | 1.0668 | 1.0472 | 1.0528 | ... |
| 1.0949 | 1.0612 | 1.0500 | 1.0472 | 1.0388 | 1.0219 | 1.0388 | ... |
| 1.1005 | 1.0275 | 1.0444 | 1.0472 | 1.0219 | 1.0332 | 1.0051 | ... |
| 1.0977 | 1.0360 | 1.0697 | 1.0416 | 1.0528 | 1.0640 | 1.0584 | ... |
| 1.0837 | 1.0556 | 1.0781 | 1.0640 | 1.0388 | 1.0500 | 1.0556 | ... |
| 1.0893 | 1.0640 | 1.0640 | 1.0472 | 1.0360 | 1.0584 | 1.0472 | ... |
| 1.1202 | 1.0500 | 1.0444 | 1.0500 | 1.0303 | 1.0388 | 1.0360 | ... |
| ... | ... | ... | ... | ... | ... | ... | ... |

Shading indicates columns to be removed in thinning

FIG. 5B

| | | | | |
|---|---|---|---|---|
| 1.1090 | 1.0893 | 1.1230 | 1.1146 | ... |
| 1.0668 | 1.0640 | 1.0668 | 1.0528 | ... |
| 1.0949 | 1.0500 | 1.0388 | 1.0388 | ... |
| 1.1005 | 1.0444 | 1.0219 | 1.0051 | ... |
| 1.0977 | 1.0697 | 1.0528 | 1.0584 | ... |
| 1.0837 | 1.0781 | 1.0388 | 1.0556 | ... |
| 1.0893 | 1.0640 | 1.0360 | 1.0472 | ... |
| 1.1202 | 1.0444 | 1.0303 | 1.0360 | ... |
| ... | ... | ... | ... | ... |

FIG. 5C

| | | | | | | | |
|---|---|---|---|---|---|---|---|
| 1.1090 | 1.0992 | 1.0893 | 1.1062 | 1.1230 | 1.1188 | 1.1146 | ... |
| 1.0668 | 1.0654 | 1.0640 | 1.0654 | 1.0668 | 1.0598 | 1.0528 | ... |
| 1.0949 | 1.0725 | 1.0500 | 1.0444 | 1.0388 | 1.0388 | 1.0388 | ... |
| 1.1005 | 1.0725 | 1.0444 | 1.0332 | 1.0219 | 1.0135 | 1.0051 | ... |
| 1.0977 | 1.0837 | 1.0697 | 1.0613 | 1.0528 | 1.0556 | 1.0584 | ... |
| 1.0837 | 1.0809 | 1.0781 | 1.0585 | 1.0388 | 1.0472 | 1.0556 | ... |
| 1.0893 | 1.0767 | 1.0640 | 1.0500 | 1.0360 | 1.0416 | 1.0472 | ... |
| 1.1202 | 1.0823 | 1.0444 | 1.0374 | 1.0303 | 1.0332 | 1.0360 | ... |
| ... | ... | ... | ... | ... | ... | ... | ... |

FIG. 10

| | | | |
|---|---|---|---|
| i1 | i2 | i3 | ... |
| e1 | e2 | e3 | ... |
| E1 | E2 | E3 | ... |
| d1 | d2 | d3 | ... |

Corresponds to single row

FIG. 11A

| | | | | | | | | |
|---|---|---|---|---|---|---|---|---|
| 1.1090 | 1.1427 | 1.0893 | 1.1033 | 1.1230 | 1.1314 | 1.1146 | 1.1230 | ... |
| 1.0668 | 1.0753 | 1.0640 | 1.0584 | 1.0668 | 1.0472 | 1.0528 | 1.0416 | ... |
| 1.0949 | 1.0612 | 1.0500 | 1.0472 | 1.0388 | 1.0219 | 1.0388 | 1.0528 | ... |
| 1.1005 | 1.0275 | 1.0444 | 1.0472 | 1.0219 | 1.0332 | 1.0051 | 1.0668 | ... |
| 1.0977 | 1.0360 | 1.0697 | 1.0416 | 1.0528 | 1.0640 | 1.0584 | 1.0444 | ... |
| 1.0837 | 1.0556 | 1.0781 | 1.0640 | 1.0388 | 1.0500 | 1.0556 | 1.0444 | ... |
| 1.0893 | 1.0640 | 1.0640 | 1.0472 | 1.0360 | 1.0584 | 1.0472 | 1.0528 | ... |
| 1.1202 | 1.0500 | 1.0444 | 1.0500 | 1.0303 | 1.0388 | 1.0360 | 1.0528 | ... |
| ... | ... | ... | ... | ... | ... | ... | ... | ... |

Shading indicates columns to be removed in thinning

FIG. 11B

| | | | | | | | | |
|---|---|---|---|---|---|---|---|---|
| 0.0000 | 0.0000 | 0.0000 | 0.0000 | 0.0000 | 0.0000 | 0.0000 | 0.0000 | ... |
| 0.0067 | 0.0112 | 0.0006 | -0.0027 | 0.0017 | 0.0037 | 0.0019 | 0.0018 | ... |
| 0.0027 | 0.0045 | -0.0013 | -0.0036 | -0.0020 | -0.0021 | -0.0026 | -0.0036 | ... |
| -0.0012 | -0.0019 | -0.0001 | 0.0006 | -0.0025 | -0.0044 | 0.0012 | 0.0035 | ... |
| -0.0071 | -0.0119 | 0.0013 | 0.0062 | 0.0030 | 0.0030 | 0.0070 | 0.0106 | ... |
| -0.0087 | -0.0145 | -0.0037 | -0.0014 | 0.0009 | 0.0019 | 0.0003 | -0.0001 | ... |
| -0.0052 | -0.0086 | 0.0001 | 0.0030 | 0.0009 | 0.0005 | -0.0002 | -0.0004 | ... |
| -0.0029 | -0.0048 | -0.0005 | 0.0008 | 0.0027 | 0.0042 | 0.0025 | 0.0028 | ... |
| ... | ... | ... | ... | ... | ... | ... | ... | ... |

FIG. 11C

| | | | | | | | | |
|---|---|---|---|---|---|---|---|---|
| 1.1090 | 1.1070 | 1.1049 | 1.1121 | 1.1192 | 1.1195 | 1.1198 | 1.1171 | ... |
| 1.0735 | 1.0722 | 1.0708 | 1.0672 | 1.0635 | 1.0576 | 1.0517 | 1.0551 | ... |
| 1.0976 | 1.0718 | 1.0460 | 1.0418 | 1.0376 | 1.0338 | 1.0301 | 1.0379 | ... |
| 1.0993 | 1.0635 | 1.0277 | 1.0279 | 1.0281 | 1.0193 | 1.0105 | 1.0364 | ... |
| 1.0906 | 1.0706 | 1.0507 | 1.0523 | 1.0539 | 1.0609 | 1.0680 | 1.0555 | ... |
| 1.0750 | 1.0686 | 1.0623 | 1.0531 | 1.0438 | 1.0502 | 1.0566 | 1.0456 | ... |
| 1.0841 | 1.0707 | 1.0573 | 1.0477 | 1.0380 | 1.0455 | 1.0529 | 1.0435 | ... |
| 1.1173 | 1.0743 | 1.0312 | 1.0354 | 1.0397 | 1.0398 | 1.0399 | 1.0333 | ... |
| ... | ... | ... | ... | ... | ... | ... | ... | ... |

FIG. 11D

| | | | | |
|---|---|---|---|---|
| 1.1090 | 1.1049 | 1.1192 | 1.1198 | ... |
| 1.0735 | 1.0708 | 1.0635 | 1.0517 | ... |
| 1.0976 | 1.0460 | 1.0376 | 1.0301 | ... |
| 1.0993 | 1.0277 | 1.0281 | 1.0105 | ... |
| 1.0906 | 1.0507 | 1.0539 | 1.0680 | ... |
| 1.0750 | 1.0623 | 1.0438 | 1.0566 | ... |
| 1.0841 | 1.0573 | 1.0380 | 1.0529 | ... |
| 1.1173 | 1.0312 | 1.0397 | 1.0399 | ... |
| ... | ... | ... | ... | ... |

FIG. 11E

| | | | | | | | | |
|---|---|---|---|---|---|---|---|---|
| 1.1090 | 1.1070 | 1.1049 | 1.1121 | 1.1192 | 1.1195 | 1.1198 | 1.1171 | ... |
| 1.0735 | 1.0722 | 1.0708 | 1.0672 | 1.0635 | 1.0576 | 1.0517 | 1.0551 | ... |
| 1.0976 | 1.0718 | 1.0460 | 1.0418 | 1.0376 | 1.0338 | 1.0301 | 1.0379 | ... |
| 1.0993 | 1.0635 | 1.0277 | 1.0279 | 1.0281 | 1.0193 | 1.0105 | 1.0364 | ... |
| 1.0906 | 1.0706 | 1.0507 | 1.0523 | 1.0539 | 1.0609 | 1.0680 | 1.0555 | ... |
| 1.0750 | 1.0686 | 1.0623 | 1.0531 | 1.0438 | 1.0502 | 1.0566 | 1.0456 | ... |
| 1.0841 | 1.0707 | 1.0573 | 1.0477 | 1.0380 | 1.0455 | 1.0529 | 1.0435 | ... |
| 1.1173 | 1.0743 | 1.0312 | 1.0354 | 1.0397 | 1.0398 | 1.0399 | 1.0333 | ... |
| ... | ... | ... | ... | ... | ... | ... | ... | ... |

DISPLAY DEVICE, DISPLAY DEVICE CORRECTION METHOD, DISPLAY DEVICE MANUFACTURING METHOD, AND DISPLAY DEVICE DISPLAY METHOD

CROSS REFERENCE TO RELATED APPLICATION

The present application is based on and claims priority of Japanese Patent Application No. 2016-212350 filed on Oct. 28, 2016. The entire disclosure of the above-identified application, including the specification, drawings and claims is incorporated herein by reference in its entirety.

Field

The present disclosure relates to a display device, a display device correction method, a display device manufacturing method, and a display device display method.

Background

One example of a known display device that uses current-driven light emitting elements is an organic electroluminescent (EL) display. Organic EL displays have gained attention due to their wide viewing angle and low power consumption.

Usually, in organic EL displays, the organic EL elements that form the pixels are arranged in a matrix. In active matrix organic EL displays in particular, even if there is an increase in the duty cycle, this increase does not lead to a reduction in luminance due to the displays ability to illuminate the organic EL elements until the next scan (selection). This makes it possible to drive the display at a low voltage, resulting in lower power consumption. However, one shortcoming of active matrix organic EL displays is that they are susceptible to appearing uneven in luminance due to the luminances between interpixel organic EL elements being different even when the same luminance signal is applied, caused by variances in driver transistor and/or organic EL element characteristics.

One proposed conventional method for correcting luminance unevenness in an organic EL display device is a compensation method for non-uniform interpixel characteristics involving correcting luminance signals using correction data stored in advance in memory.

For example, Patent Literature (PTL) 1 discloses a manufacturing method for an organic EL display device including obtaining, in a display panel including pixels including organic EL elements and driver transistors, representative current-voltage characteristics, luminance-current characteristics of each partitioned region, and luminance-current characteristics of each pixel, and obtaining correction data for each pixel that corrects the obtained current-voltage characteristics for each pixel to the representative current-voltage characteristics. With this, since precise correction data is obtained, unevenness in the degradation in luminance with age can be inhibited.

CITATION LIST

Patent Literature

[PTL 1] WO 2011/118124

SUMMARY

Technical Problem

However, with the organic EL display device disclosed in PTL 1, correction data (gain and offset) derived in advance for each pixel is stored in memory in the control circuit. Accordingly, when the resolution of the display panel is increased and the precision of the correction data is maintained, there is a problem that the size of the correction data significantly increases. This is a serious problem in particular with, for example, compact, high-definition tablet devices, which are in high demand.

The present disclosure has been conceived in view of the above problem and has an object to provide a display device, a display device correction method, a display device manufacturing method, and a display device display method with reduced correction data size.

Solution to Problem

In order to solve the above problem, according to one aspect of the present invention, a display device correction method for correcting luminance unevenness in a display device including a matrix of pixels each including a light emitting element that emits light in accordance with a luminance signal, includes: obtaining, in advance, first correction data for correcting the luminance signal, the first correction data including correction data components corresponding to the pixels; performing a first transform including applying an error diffusion method to at least one of the correction data components included in the first correction data to transform the first correction data into second correction data including correction data components corresponding to the pixels, the error diffusion method including diffusing an error component of a current correction data component among the at least one of the correction data components to a correction data component corresponding to a neighboring pixel of a pixel corresponding to the current correction data component; performing a second transform including thinning, via a predetermined thinning method, the correction data components included in the second correction data by removing at least one but not all of the correction data components to transform the second correction data into third correction data smaller in data size than the first correction data; performing a third transform including interpolation, via a predetermined interpolation method, using pixel data components included in the third correction data to transform the third correction data into fourth correction data including correction data components corresponding to the pixels; and correcting the luminance signal using the fourth correction data, wherein, in the performing of the first transform, based on the predetermined thinning method and the predetermined interpolation method, the transform is performed such that the second correction data and the fourth correction data match.

Moreover, a display device manufacturing method according to one aspect of the present invention is a method for manufacturing a display device including a matrix of pixels each including a light emitting element that emits light in accordance with a luminance signal, including: obtaining, in advance, first correction data for correcting the luminance signal, the first correction data including correction data components corresponding to the pixels; performing a first transform including applying an error diffusion method to at least one of the correction data components included in the first correction data to transform the first correction data into second correction data including correction data components corresponding to the pixels, the error diffusion method including diffusing an error component of a current correction data component among the at least one of the correction data components to a correction data component corresponding to a neighboring pixel of a pixel corresponding to the current correction data component; performing a second transform including thinning, via a predetermined thinning method, the correction data components included in the second correction data by removing at least one but not all of the correction data components to transform the second correction data into third correction data smaller in data size than the first correction data; and storing the third correction data in memory included in the display device, wherein fourth correction data is derived by interpolation, via a predetermined interpolation method, performed on the third correction data, using pixel data components included in the third correction data, and in the performing of the first transform, the transform is performed based on the predetermined thinning method and the predetermined interpolation method such that the second correction data and the fourth correction data match.

Moreover, a display device display method according to one aspect of the present invention is a method for a display device including a matrix of pixels each including a light emitting element that emits light in accordance with a luminance signal, including: performing a third transform including interpolation, via a predetermined interpolation method, using pixel data components included in third correction data to transform the third correction data into fourth correction data including correction data components corresponding to the pixels, the third correction data being derived by (i) obtaining, in advance, first correction data for correcting the luminance signal, the first correction data including correction data components corresponding to the pixels, (ii) performing a first transform including applying an error diffusion method to at least one of the correction data components included in the first correction data to transform the first correction data into second correction data including correction data components corresponding to the pixels, the error diffusion method including diffusing an error component of a current correction data component among the at least one of the correction data components to a correction data component corresponding to a neighboring pixel of a pixel corresponding to the current correction data component, and (ii) performing a second transform including thinning, via a predetermined thinning method, the correction data components included in the second correction data by removing at least one but not all of the correction data components to transform the second correction data into third correction data smaller in data size than the first correction data; and correcting the luminance signal using the fourth correction data, wherein, in the performing of the first transform, based on the predetermined thinning method and the predetermined interpolation method, the transform is performed such that the second correction data and the fourth correction data match.

Moreover, a display device according to one aspect of the present invention is a device including a matrix of pixels each including a light emitting element that emits light in accordance with a luminance signal, and includes: an error diffusion unit configured to apply an error diffusion method to at least one of correction data components that are included in first correction data and correspond to the pixels, to transform the first correction data into second correction data including correction data components corresponding to the pixels, the error diffusion method including diffusing an error component of a current correction data component among the at least one of the correction data components to a correction data component corresponding to a neighboring pixel of a pixel corresponding to the current correction data component, the first correction data being for correcting the luminance signal; a thinning unit configured to thin, via a predetermined thinning method, the correction data components included in the second correction data by removing at least one but not all of the correction data components to transform the second correction data into third correction data smaller in data size than the first correction data; an interpolation unit configured to perform interpolation, via a predetermined interpolation method, using pixel data components included in the third correction data to transform the third correction data into fourth correction data including correction data components corresponding to the pixels; and a luminance signal correction unit configured to correct the luminance signal using the fourth correction data, wherein the error diffusion unit is configured to transform the first correction data into the second correction data based on the predetermined thinning method and the predetermined interpolation method such that the second correction data and the fourth correction data match.

Moreover, a display device according to one aspect of the present invention is device including a matrix of pixels each including a light emitting element that emits light in accordance with a luminance signal, and includes: an interpolation unit configured to perform interpolation, via a predetermined interpolation method, using pixel data components included in third correction data to transform the third correction data into fourth correction data including correction data components corresponding to the pixels, the third correction data being derived by (i) obtaining, in advance, first correction data for correcting the luminance signal, the first correction data including correction data components corresponding to the pixels, (ii) performing a first transform including applying an error diffusion method to at least one of the correction data components included in the first correction data to transform the first correction data into second correction data including correction data components corresponding to the pixels, the error diffusion method including diffusing an error component of a current correction data component among the at least one of the correction data components to a correction data component corresponding to a neighboring pixel of a pixel corresponding to the current correction data component, and (ii) performing a second transform including thinning, via a predetermined thinning method, the correction data components included in the second correction data by removing at least one but not all of the correction data components to transform the second correction data into third correction data smaller in data size than the first correction data; and a luminance signal correction unit configured to correct the luminance signal using the fourth correction data, wherein, in the performing of the first transform, based on the predetermined thinning method and the predetermined interpolation method, the transform is performed such that the second correction data and the fourth correction data match.

Advantageous Effects

With a display device, a display device correction method, a display device manufacturing method, and a display device display method according to the present disclosure, a luminance signal is corrected using third correction data smaller in data size than first correction data, and thus correction data size can be reduced.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

FIG. 5A illustrates a data configuration of first correction data.

FIG. 5B illustrates a data configuration of thinned correction data.

FIG. 5C illustrates a data configuration of interpolated correction data.

FIG. 10 schematically illustrates an error diffusion transform performed by an error diffusion unit.

FIG. 11A illustrates a data configuration of first correction data.

FIG. 11B illustrates a data configuration of error values propagated from the above row.

FIG. 11C illustrates a data configuration of second correction data.

FIG. 11D illustrates a data configuration of third correction data.

FIG. 11E illustrates a data configuration of fourth correction data.

DESCRIPTION OF EMBODIMENTS

Hereinafter, exemplary embodiments of the display device and the display device correction method will be described in detail with reference to the drawings. Note that each of the exemplary embodiments described below represents a preferred, specific example of the present disclosure. The numerical values, shapes, materials, elements, the arrangement and connection of the elements, steps, the processing order of the steps, etc. shown in the following exemplary embodiments are mere examples, and therefore do not limit the scope of the present disclosure, which is defined by the appended claims. Thus, among the elements in the following exemplary embodiments, those not recited in any one of the independent claims which indicate the broadest inventive concepts are described as optional elements.

Note that the respective figures are schematic diagrams and are not necessarily precise illustrations. Additionally, like reference signs indicate like elements. As such, overlapping explanations of like elements are omitted or simplified.

Embodiment 1

(1.1 Display Device Configuration)

Figure 1:
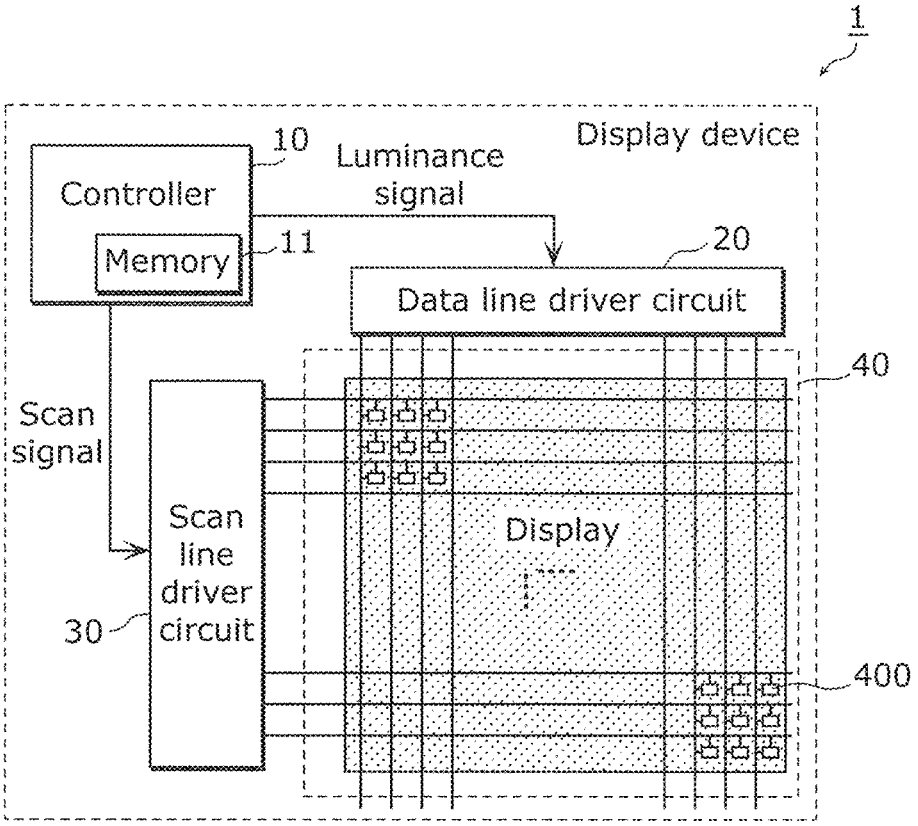
FIG. 1 is a block diagram illustrating a configuration of the display device according to Embodiment 1.

FIG. 1 is a block diagram illustrating a configuration of the display device 1 according to Embodiment 1. The display device 1 illustrated in FIG. 1 includes a controller 10, a data line driver circuit 20, a scan line driver circuit 30, and a display 40. The controller 10 includes memory 11. Note that the memory 11 may be included in the display device 1, external from the controller 10.

The controller 10 controls the memory 11, the data line driver circuit 20, and the scan line driver circuit 30. For example, after manufacturing of the display device 1 is complete, processed correction data (thinned correction data; to be described later) is stored in the memory 11.

When the display is operating, the controller 10 reads the thinned correction data written to the memory 11, and based on the thinned correction data, corrects a video signal (luminance signal) input from an external source and outputs the corrected signal to the data line driver circuit 20.

Moreover, when, for example, unprocessed correction data (first correction data; to be described later) is generated during manufacturing, the controller 10, for example, communicates with an external information processing device, and drives the data line driver circuit 20 and the scan line driver circuit 30 in accordance with instruction from the information processing device.

For example, the controller 10 applies a transform to unprocessed correction data (first correction data) during manufacturing to generate processed (transformed) correction data (thinned correction data), and stores the processed correction data in the memory 11.

The display 40 includes pixels arranged in a matrix, and displays an image based on a video signal (luminance signal) input from an external source to display device 1.

Figure 2:
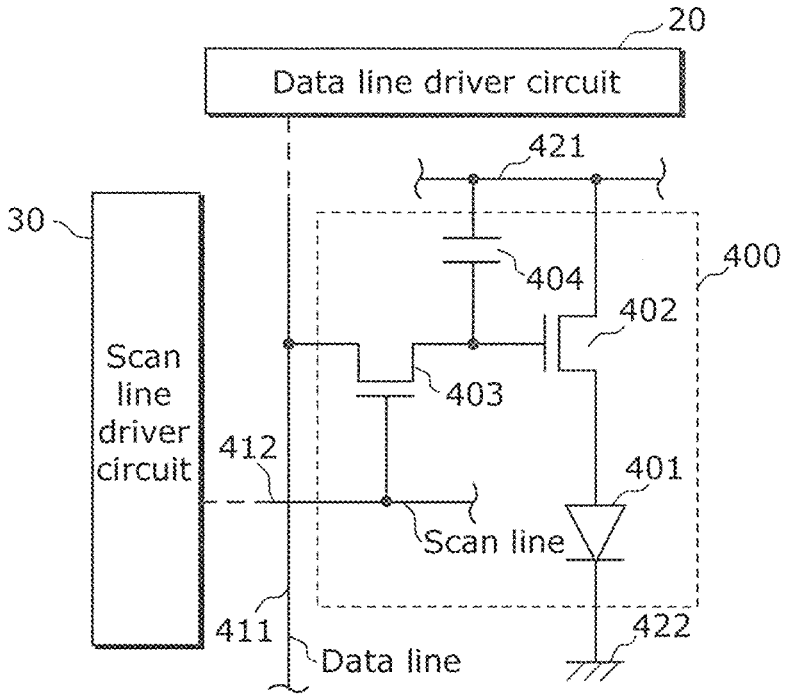
FIG. 2 illustrates the connectivity between one example of a circuit configuration of a pixel according to Embodiment 1 and surrounding circuits.

FIG. 2 illustrates the connectivity between one example of a circuit configuration of a pixel 400 according to Embodiment 1 and surrounding circuits. The pixel 400 in FIG. 2 includes a scan line 412, a data line 411, a power line 421, a selection transistor 403, a driver transistor 402, an organic EL element 401, a holding capacitor 404, and a common electrode 422. The surrounding circuits include the data line driver circuit 20 and the scan line driver circuit 30.

The scan line driver circuit 30 is connected to the scan line 412, and controls the conductivity of the selection transistor 403 in the pixel 400.

The data line driver circuit 20 is connected to the data line 411, and has a function of outputting data voltage, which is a luminance signal corrected using the thinned correction data, and determining the signal current that flows to driver transistor 402.

The selection transistor 403 has a gate terminal connected to the scan line 412, and controls the timing at which the data voltage from the data line 411 is supplied to the gate terminal of the driver transistor 402.

The driver transistor 402 has a gate terminal connected to the data line 411 via the selection transistor 403, a source terminal connected to an anode terminal of the organic EL element 401, and a drain terminal connected to the power line 421. With this, the driver transistor 402 transforms the data voltage supplied to its gate terminal into a signal current corresponding to the data voltage, and supplies the transformed signal current to the organic EL element 401.

The organic EL element 401 functions as a light emitting element, and the cathode of the organic EL element 401 is connected to the common electrode 422.

The holding capacitor 404 is connected between the power line 421 and the gate terminal of the driver transistor 402. The holding capacitor 404, for example, maintains the previous gate voltage even after the selection transistor 403 turns OFF, whereby the drive current can be continuously supplied from the driver transistor 402 to the organic EL element 401.

Although not illustrated in FIG. 1 or FIG. 2, note that the power line 421 is connected to a power source. The common electrode 422 is also connected to a power source.

The data voltage supplied from the data line driver circuit 20 is applied to the gate terminal of the driver transistor 402 via the selection transistor 403. The driver transistor 402 passes current in accordance with the data voltage across the source and drain terminals. The current flows to the organic EL element 401, causing the organic EL element 401 to emit light of a luminance corresponding to the current.

Note that in the configuration of the circuit of the pixel 400 illustrated in FIG. 2, other circuit components or lines may be inserted along the paths connecting the circuit components.

(1.2 Controller Configuration)

Figure 3:
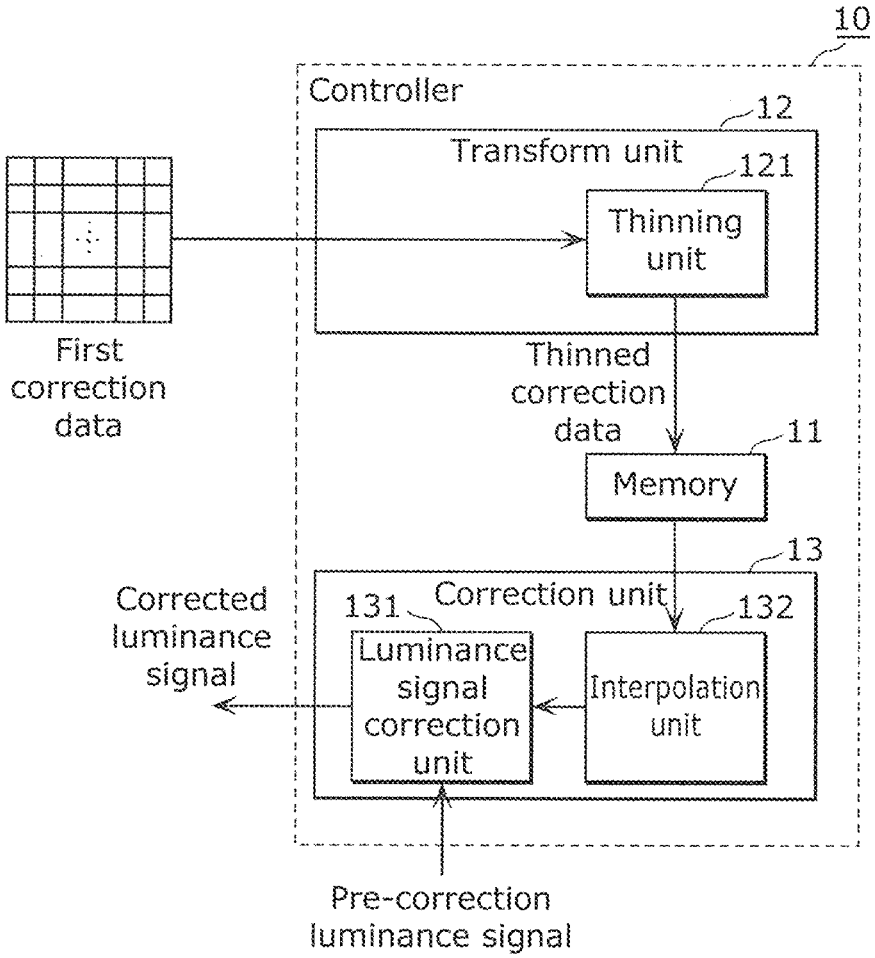
FIG. 3 is a block diagram illustrating a configuration of the controller included in the display device according to Embodiment 1.

FIG. 3 is a block diagram illustrating a configuration of the controller 10 included in the display device 1 according to Embodiment 1. The controller 10 illustrated in FIG. 3 includes the memory 11, a transform unit 12, and a correction unit 13.

The transform unit 12 transforms unprocessed correction data (first correction data) into processed correction data (thinned correction data) smaller in data size than the first correction data.

The correction unit 13 uses the thinned correction data to correct the luminance signal. The luminance signal is an electric signal for causing light emitting elements in pixels to emit light, and is applied to the pixels. More specifically, in this embodiment, the luminance signal is data voltage applied from the data line driver circuit 20 to the gate of the driver transistor 402 in order to cause the organic EL element 401 included in the pixel 400 to emit light.

Next, unprocessed correction data (first correction data) will be described. For example, the first correction data is data for reducing luminance unevenness when the pixels 400 in the display 40 emit light based on a video signal transmitted from an external source to the display device 1. More specifically, for example, the correction data includes two correction parameters corresponding to a pixel 400: a gain correction value and an offset correction value. Note that the correction data need not correspond to a pixel 400, and may correspond to a group of neighboring pixels.

Figure 4:
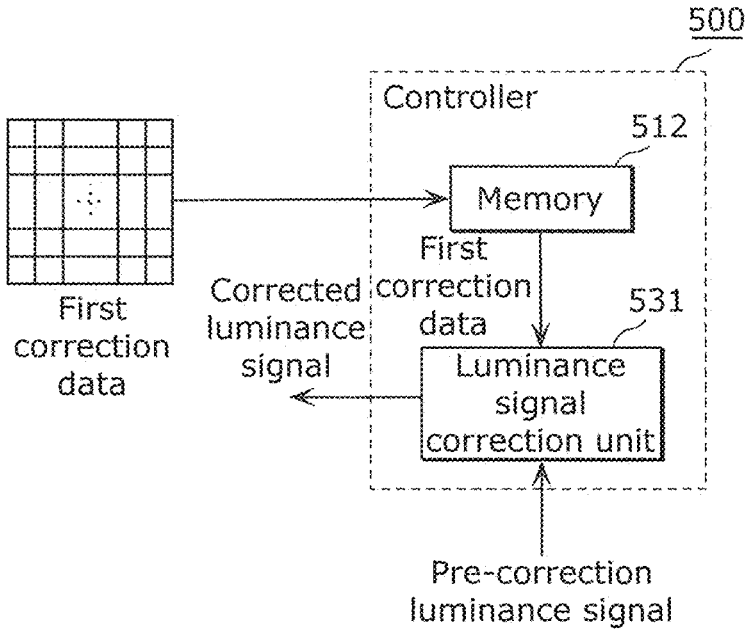
FIG. 4 Prior Art
FIG. 4 is a block diagram illustrating a configuration of a controller included in a conventional display device.

FIG. 4 is a block diagram illustrating a configuration of a controller 500 included in a conventional display device. The controller 500 illustrated in FIG. 4 includes memory 512 and a luminance signal correction unit 531. In this conventional display device, the controller 500 stores the first correction data in the memory 512 in advance. Moreover, the controller 500 transforms a video signal to generate a luminance signal (pre-correction luminance signal) per pixel. The luminance signal correction unit 531 reads the first correction data from the memory 512, multiplies (or divides) the gain correction value and adds (or subtracts) the offset correction value of the first correction data with the pre-correction luminance signal to correct the pre-correction luminance signal. The controller 500 outputs the corrected luminance signal to a line driver circuit at a predetermined timing. This is how luminance unevenness is reduced in the display.

A problem with this conventional display device is that the size of the correction data to be stored in the memory 512 increases with an increase in the resolution of the display, and the data transfer rate of, for example, the luminance signal increases. In particular, with compact, high-definition tablet devices, which are in high demand, usage of large capacity memories is problematic, and leads to an increase in cost.

In contrast, with the display device 1 according to this embodiment, the luminance signal is not corrected by the first correction data (unprocessed correction data), but rather by processed correction data (thinned correction data) derived by processing the unprocessed correction data (first correction data) so as to reduce its data size. Hereinafter, the configuration of the display device 1 according to this embodiment for generating the thinned correction data from the first correction data will be described.

In FIG. 3, the transform unit 12 includes a thinning unit 121.

The thinning unit 121 thins the correction data components included in the first correction data by removing at least one but not all of the correction data components using a predetermined thinning method to transform the first correction data into thinned correction data smaller in data size than the first correction data.

Here, the predetermined thinning method is a method of removing correction data components corresponding to pixels in even-numbered columns in the matrix of the pixels 400.

Note that the predetermined thinning method is not necessarily limited to the above described thinning method. For example, a method of removing correction data components corresponding to pixels in columns not divisible by 3 in the matrix of the pixels 400 is conceivable.

FIG. 5A illustrates the data configuration of one example of the first correction data. FIG. 5B illustrates the data configuration of thinned correction data derived by thinning the first correction data illustrated in FIG. 5A by the thinning unit 121.

As illustrated in FIG. 5A and FIG. 5B, the number of correction data components included in the thinned correction data is half that of the first correction data.

The memory 11 stores the thinned correction data generated by the transform unit 12 applying a transform to the first correction data. The thinned correction data is smaller in data size than the first correction data. This results in the advantageous effect that the capacity of the memory 11 that stores the thinned correction data reduced in data size by the transform unit 12 can be reduced when the resolution of the display 40 is increased. Since there is no need to have an excessively large capacity and long lifespan for the storage medium, for example, non-volatile memory, such as flash memory, can be used as the memory 11.

Next, returning to FIG. 3, description of the controller 10 will continue.

The correction unit 13 includes an interpolation unit 132 and a luminance signal correction unit 131.

The interpolation unit 132 includes, for example, first memory that is volatile, such as DRAM, and an operation circuit. The interpolation unit 132 reads the thinned correction data from the memory 11 and temporarily stores the thinned correction data in the first memory. The operation circuit then performs a predetermined interpolation method using pixel data components included in the thinned correction data to transform the thinned correction data into interpolated correction data including a plurality of correction data components corresponding to the pixels 400 in the display 40.

Here, the predetermined interpolation method is linear interpolation performed for each correction data component included in the removed correction data removed by the thinning unit 121, by using correction data components corresponding to pixels to the immediate left and right of and in the same row as the target pixel corresponding to the current correction data component in the matrix of the pixels 400.

Note that the predetermined interpolation method is not necessarily limited to the above described interpolation method. For example, when a method of removing correction data components corresponding to pixels in columns not divisible by 3 in the matrix of the pixels 400 is used as the predetermined thinning method, the following interpolation method is used. Linear interpolation performed for each correction data component included in the removed correction data removed by the thinning unit 121, by using pixel data components corresponding to the closest pixels not removed in the thinning to the left and right of and in the same row as the target pixel corresponding to the current correction data component in the matrix of the pixels 400.

FIG. 5C illustrates the data configuration of the interpolated correction data derived by interpolation unit 132 from the thinned correction data illustrated in FIG. 5B.

As illustrated in FIG. 5A and FIG. 5C, the number of correction data components included in the interpolated correction data correction data is the same as the first correction data.

Next, returning to FIG. 3, description of the controller 10 will continue.

The luminance signal correction unit 131 corrects the luminance signal corresponding to a pixel 400 using the interpolated correction data correction data derived by the interpolation unit 132. Hereinafter, one example of the processes for correcting the luminance signal in the luminance signal correction unit 131 will be given.

The luminance signal correction unit 131 multiplies (or divides) the gain correction value of the interpolated correction data and adds (or subtracts) the offset correction value of the corrected correction data with the pre-correction luminance signal to correct the pre-correction luminance signal.

With the display device 1 configured as described above, the data size of the thinned correction data stored in the memory 11 is reduced to about ½ the size of the first correction data when the first correction data is stored as-is.

Thus, with the display device 1 according to Embodiment 1, even if the number of pixels in the display is increased, the correction data size and data transfer rate can be reduced.

Note that in the display device 1 according to Embodiment 1, the transform unit 12 and the correction unit 13 may be realized as integrated circuits (IC) or by large-scale integrated (LSI) circuits. Moreover, the method of integration may be a dedicated circuit or a generic processor. A Field Programmable Gate Array (FPGA) or a reconfigurable processor that allows reconfiguration of the connection or configuration of the inner circuit cells of the LSI circuit can be used for the same purpose. Further, if integrated circuit technology that replaces LSI is newly created from advances in or derivations of semiconductor technology, integration of functional blocks using such technology may also be used. Moreover, the transform unit 12 and the correction unit 13 may be realized as a program that executes the above-described encoding and decoding processing, and may be realized as a computer-readable non-transitory recording medium storing such a program. Examples of the computer-readable non-transitory recording medium include flexible disk, hard disk, CD-ROM, MO, DVD, DVD-ROM, DVD-RAM, Blu-Ray™ (BR) disc, and semiconductor memory. It goes without saying that such a program can be distributed via a recordable medium such as a CD-ROM or over a transmission medium such as the Internet.

(1.3 Display Device Correction Method)

Next, the correction method performed by the display device 1 according to this embodiment will be described.

Figure 6:
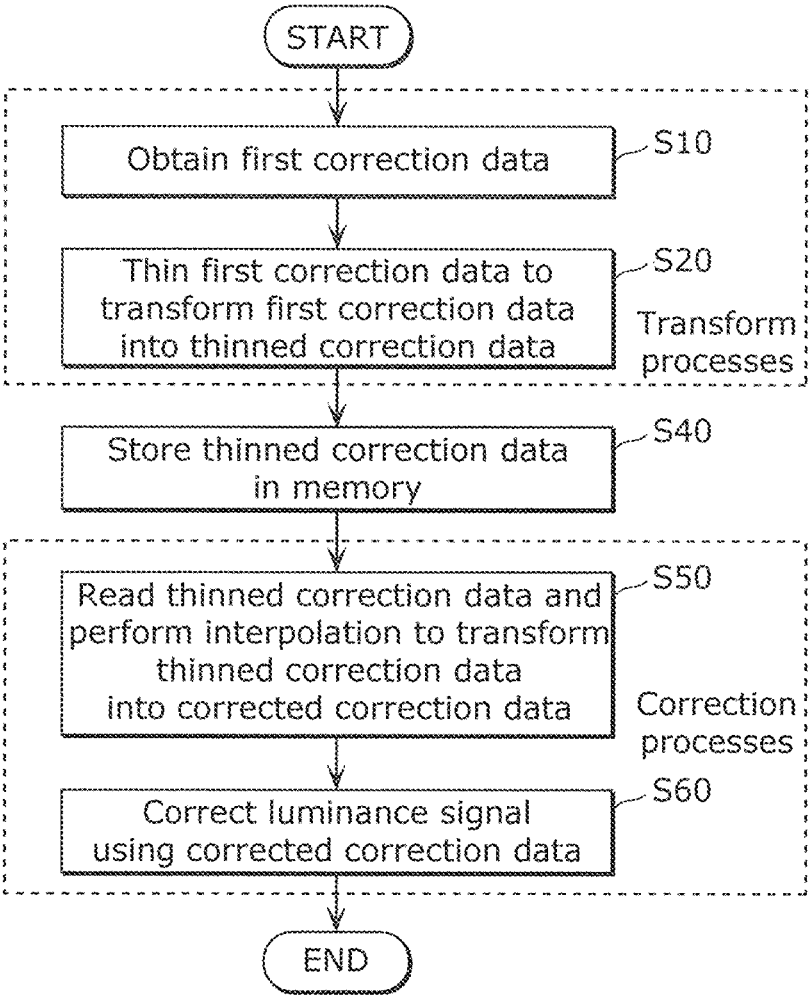
FIG. 6 is an operational flow chart illustrating the correction method used by the display device according to Embodiment 1.

FIG. 6 is an operational flow chart illustrating the correction method performed by the display device 1 according to Embodiment 1. FIG. 6 illustrates steps up to the correction of the luminance signal using the second correction data by the controller 10 included in the display device 1. Hereinafter, the correction steps will be described with reference to FIG. 6.

First, the controller 10 obtains, in advance, the first correction data (unprocessed correction data) for correcting the luminance signal for causing the organic EL elements 401 to emit light at a predetermined luminance (S10; obtaining step). As previously described, the first correction data (unprocessed correction data) includes, for example, two correction parameters: a gain correction value and an offset correction value, which correspond to a pixel 400.

Next, an example of the method of obtaining the first correction parameters will be given.

Figure 7:
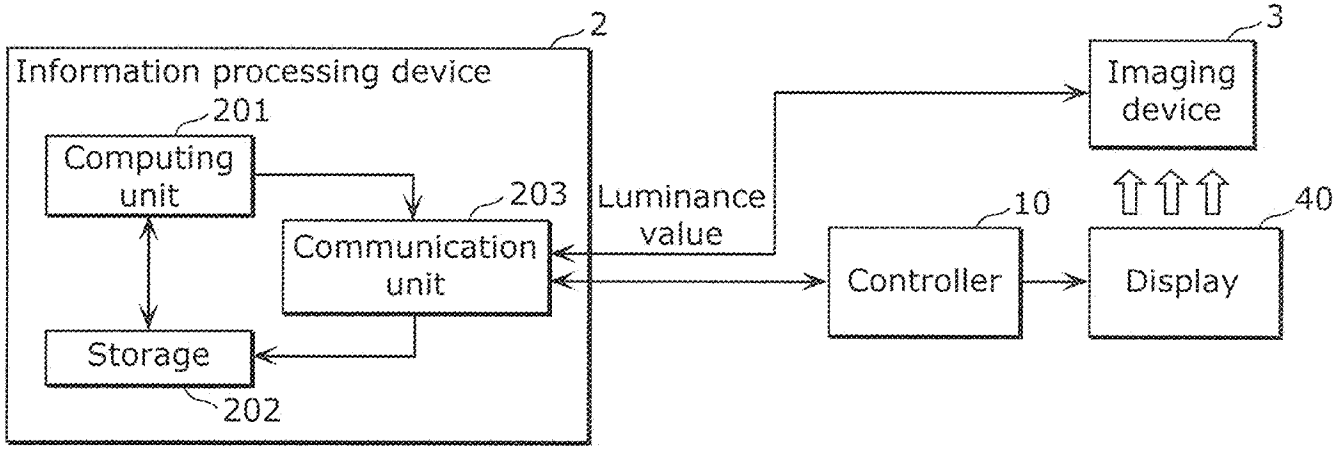
FIG. 7 is a block diagram of a measurement system for obtaining the first correction data.

FIG. 7 is a block diagram of a measurement system for obtaining the first correction data. The measurement system illustrated in FIG. 7 includes an information processing device 2, an imaging device 3, the display 40, and the controller 10.

The information processing device 2 includes a computing unit 201, storage 202, and a communication unit 203, and has a function of controlling the steps performed up until the generation of the first correction parameters. For example, a personal computer is used as the information processing device 2.

Based on a control signal from the communication unit 203, the imaging device 3 images the display 40 and outputs the imaged image data to the communication unit 203. For example, a CCD camera or luminance meter is used as the imaging device 3.

The information processing device 2 outputs a control signal to the controller 10 and the imaging device 3 in the display device 1 to the communication unit 203, obtains measurement data from the controller 10 and the imaging device 3 and stores the measurement data in the storage 202, and calculates, using the computing unit 201, various characteristic values and parameters based on the stored measurement data. Note that a control circuit not included in the display device 1 may be used as the controller 10.

More specifically, the information processing device 2 may control the voltage value to be applied to a measurement pixel. The controller 10 applies the voltage value to the measurement pixel to cause the measurement pixel to emit light. The imaging device 3 measures the luminance value of the measurement pixel emitting light. The information processing device 2 receives the voltage value and the measured luminance value. The information processing device 2 changes the voltage value to be applied to a measurement pixel and performs the control again to receive a different voltage value and a measured luminance value corresponding to the different voltage value. As a result of the information processing device 2 repeating these processes, the computing unit 201 calculates voltage-luminance characteristics for each measurement pixel, and compares these voltage-luminance characteristics against a reference voltage-luminance characteristic to calculate correction parameters (a gain correction value and an offset correction value) for each measurement pixel.

The controller 10 receives, as the first correction data via the communication unit 203, the above-described correction parameters calculated by the computing unit 201.

With the steps described above, the controller 10 obtains, in advance, the first correction data for correcting a luminance signal.

Next, returning to FIG. 6, description of the correction method performed by the display device 1 according to Embodiment 1 will be continued.

Next, the controller 10 thins the correction data components included in the first correction data by removing at least one but not all of the correction data components using a predetermined thinning method to transform the first correction data into thinned correction data smaller in data size than the first correction data (S20).

Step S20 is a transform step performed by the thinning unit 121 of the controller 10.

Next, the controller 10 stores, in advance, the thinned correction data in the memory 11 included in the display device 1 (S40; storing step).

Next, the controller 10 then reads the thinned correction data from the memory 11 and performs a predetermined interpolation method using pixel data components included in the thinned correction data to transform the thinned correction data into interpolated correction data including a plurality of correction data components corresponding to the pixels 400 in the display 40 (S50).

Next, the controller 10 corrects the luminance signal using the interpolated correction data (S60; correction step).

Embodiment 2

In Embodiment 1, a configuration of the display device 1 in which (1) thinned correction data is generated and stored in the memory 11 by removing at least one but not all of the correction data components included in first correction data, and (2) interpolated correction data is generated by performing interpolation on the stored thinned correction data and the generated interpolated correction data is used to correct the luminance signal is described. In contrast, in Embodiment 2, a configuration of a display device in which (1) error components of at least one of the pixel correction components included in the first correction data are diffused to neighboring pixels to generate second correction data, and third correction data is generated and stored in the memory 11 by thinning the second correction data by removing at least one but not all of the correction data components included in the second correction data, and (2) fourth correction data is generated by performing interpolation on the stored third correction data and the generated fourth correction data is used to correct the luminance signal will be described. As will be described later, this display device performs the error diffusion, the thinning, and the interpolation such that the pre-thinned second correction data and the interpolated fourth correction data match.

This display device has some functions that are different from the display device 1 according to Embodiment 1. Accordingly, the description here will focus on the points of difference.

(2.1 Display Device Configuration)

Figure 8:
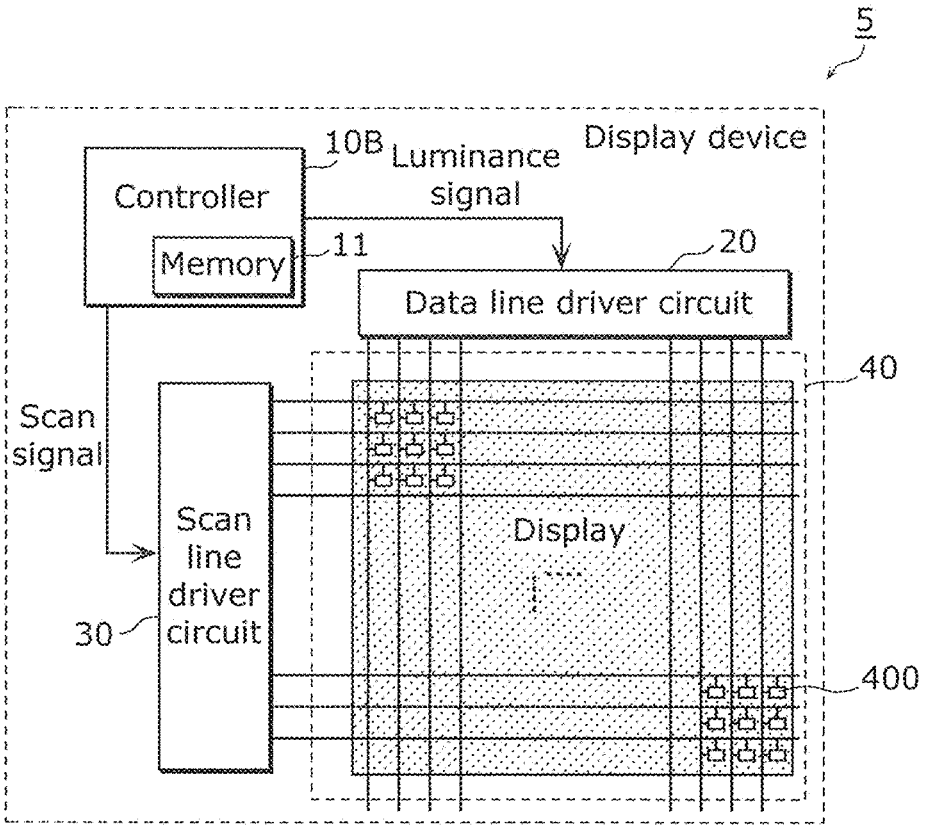
FIG. 8 is a block diagram illustrating a configuration of the display device according to Embodiment 2.

FIG. 8 is a block diagram illustrating a configuration of the display device 5 according to Embodiment 2.

As illustrated in FIG. 8, the display device 5 includes a controller 10B whereas the display device 1 according to Embodiment 1 includes the controller 10.

The controller 10B controls the memory 11, the data line driver circuit 20, and the scan line driver circuit 30. For example, after manufacturing of the display device 5 is complete, processed correction data (third correction data; to be described later) is stored in the memory 11.

Moreover, when the display is operating, the controller 10B reads the third correction data written to the memory 11 and generates the fourth correction data based on the third correction data. Then, based on the fourth correction data, the controller 103 corrects a video signal (luminance signal) input from an external source and outputs the corrected signal to the data line driver circuit 20.

Moreover, when, for example, unprocessed correction data (first correction data) is generated during manufacturing, the controller 10B, for example, communicates with an external information processing device, and drives the data line driver circuit 20 and the scan line driver circuit 30 in accordance with instruction from the information processing device.

Moreover, for example, the controller 10B applies a transform to unprocessed correction data (first correction data) during manufacturing to generate processed (transformed) correction data (third correction data), and stores the processed correction data in the memory 11.

(2.2 Controller Configuration)

Figure 9:
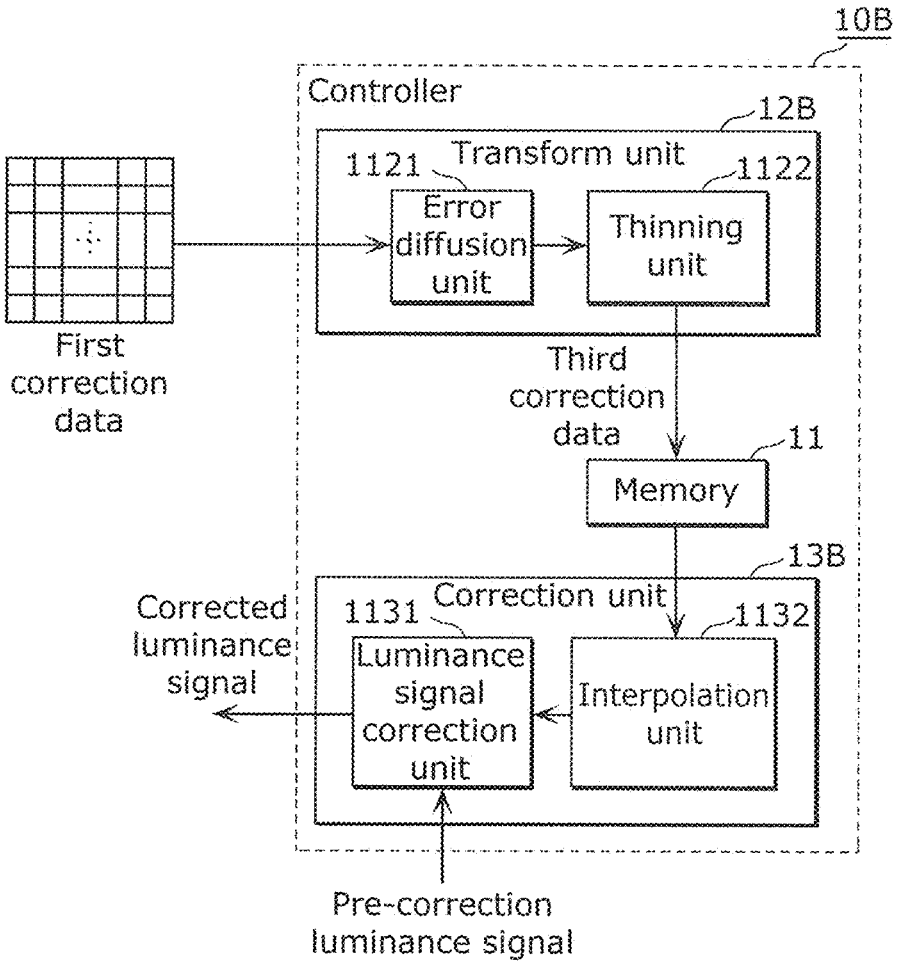
FIG. 9 is a block diagram illustrating a configuration of the controller included in the display device according to Embodiment 2.

FIG. 9 is a block diagram illustrating a configuration of the controller 10B included in the display device 5 according to Embodiment 2.

As illustrated in FIG. 9, the controller 10B includes a transform unit 126 and a correction unit 13B whereas the controller 10 according to Embodiment 1 includes the transform unit 12 and the correction unit 13.

The transform unit 12B includes an error diffusion unit 1121 and a thinning unit 1122.

The error diffusion unit 1121 applies an error diffusion method of an diffusing error component of at least one of the correction data components included in the first correction data to neighboring pixels of the correction data components to transform the first correction data into second correction data (hereinafter, this transform will also be referred to as error diffusion transform).

Here, an error component is a difference between a value of a correction data component included in the first correction data that is a candidate for application of an error diffusion method and a value of a correction data component included in the fourth correction data (to be described later) that corresponds to the above-described correction data component.

Moreover, here, at least one correction data component included in the first correction data, that is to say, the correction data components that are candidates for application of the error diffusion method, refers to those correction data components corresponding to pixels in even-numbered columns in the matrix of the pixels 400.

Note that the correction data components that are candidates for application of the error diffusion method are not necessarily limited to the correction data components described above. For example, the correction data components that are candidates for application of the error diffusion method may be correction data components corresponding to pixels in columns not divisible by 3 in the matrix of the pixels 400.

The thinning unit 1122 thins the correction data components included in the second correction data by removing at least one but not all of the correction data components using a predetermined thinning method to transform the second correction data into third correction data smaller in data size than the first correction data (hereinafter, this transform will also be referred to as thinning transform).

Here, the predetermined thinning method is a method of removing correction data components that are candidates for the error diffusion method.

Note that the predetermined thinning method is not necessarily limited to the above described thinning method. For example, a method of removing correction data components that are not candidates for the error diffusion is conceivable.

The correction unit 13B includes an interpolation unit 1132 and a luminance signal correction unit 1131.

The interpolation unit 1132 uses pixel data components included in the third correction data to transform the third correction data into fourth correction data including a plurality of correction data components corresponding to the pixels by interpolation using a predetermined interpolation method (hereinafter this transform will also be referred to as interpolation transform).

Here, the predetermined interpolation method is linear interpolation performed for each correction data component included in the third correction data derived by the thinning unit 1121, by using correction data components corresponding to pixels to the immediate left and right of and in the same row as the target pixel corresponding to the current correction data component in the matrix of the pixels 400.

Note that the predetermined interpolation method is not necessarily limited to the above described interpolation method. For example, when a method of thinning correction data components corresponding to pixels in columns not divisible by 3 in the matrix of the pixels 400 is used as the predetermined thinning method, the following interpolation method may be used. Linear interpolation performed for each correction data component included in the third correction data derived by the thinning unit 1122, by using pixel data components corresponding to the closest pixels not removed in the thinning to the left and right of and in the same row as the target pixel corresponding to the current correction data component in the matrix of the pixels 400.

Here, the error diffusion unit 1121 performs the above-described error diffusion transform such that the fourth correction data matches the second correction data.

The error diffusion unit 1121 can perform the error diffusion transform such that the fourth correction data matches the second correction data due to the thinning method of the thinning transform performed by the thinning unit 1122 being predetermined and the interpolation method of the interpolation transform performed by the interpolation unit 1132 being predetermined.

Hereinafter, one specific example of the error diffusion transform performed by the error diffusion unit 1121 for matching the fourth correction data and the second correction data will be given under the presumption that the thinning method of the thinning transform performed by the thinning unit 1122 is predetermined and the interpolation method of the interpolation transform performed by the interpolation unit 1132 is predetermined.

Here, as described above, in the error diffusion method used by the error diffusion unit 1121, pixels in even-numbered columns in the matrix of the pixels 400 are candidates for error diffusion, and 7/16 of the value of the correction data component for a candidate pixel is added to the correction data component for the pixel to the immediate right of the candidate pixel, 3/16 of the value of the correction data component for the candidate pixel is added to the correction data component for the pixel to the diagonal bottom-left of the candidate pixel, 5/16 of the value of the correction data component for the candidate pixel is added to the correction data component for the pixel below the candidate pixel, and 1/16 of the value of the correction data component for the candidate pixel is added to the correction data component for the pixel to the diagonal bottom-right of the candidate pixel (hereinafter, this error diffusion method is also referred to as the predefined error diffusion method).

The error diffusion unit 1121 performs the predefined error diffusion method on each pixel that is a candidate for error diffusion. The predefined error diffusion method is performed from the leftmost pixel to the rightmost pixel in each row in the matrix of the pixels 400 and from the topmost pixel to the bottommost pixel in each column in the matrix of the pixels 400.

The predetermined thinning method used by the thinning unit 1122 is a method of removing correction data components that are candidates for error diffusion method by the error diffusion unit 1121, as described above (hereinafter this thinning method will also be referred to as the "predefined thinning method").

Further, the predetermined interpolation method used by the interpolation unit 1132 is, as described above, linear interpolation performed for each correction data component included in the third correction data derived by the thinning unit 1122, by using correction data components corresponding to pixels to the immediate left and right of and in the same row as the target pixel corresponding to the current correction data component in the matrix of the pixels 400 (hereinafter this interpolation method will also be referred to as the "predefined interpolation method").

FIG. 10 schematically illustrates the error diffusion transform performed by the error diffusion unit 1121.

In FIG. 10, i1, i2, and i3 are values of correction data components included in the first correction data that correspond to three laterally consecutive pixels in a given row in the matrix of the pixels 400.

e1, e2, and e3 are error values propagated from the row above i1, i2, and i3 when an error diffusion method is applied to the above row.

E1, E2, and E3 are values obtained by adding the error values propagated from the row above i1, i2, and i3 (i.e., error values e1, e2, and e3), to the values of i1, i2, and i3.

d1, d2, and d3 are values corresponding to i1, i2, and i3 after they have been error diffused. In other words, d1, d2, and d3 are second correction data corresponding to i1, i2, and i3.

Here, the error diffusion unit 1121 performs the above-described error diffusion transform such that the second correction data and the fourth correction data match. Accordingly, d1, d2, and d3 are fourth correction data corresponding to i1, i2, and i3.

In FIG. 10, i1, i2, i3, e1, e2, e3, and d1 are known values at the time of calculating d2 and d3. Moreover, E1, E2, and E3 are also known since E1=i1+e1, E2=i2+e2, and E3=i3+e3. When calculating d2 and d3, d1 is a known value as a result of the error diffusion transform being performed in order from the leftmost pixel to the rightmost pixel in each row in the matrix of the pixels 400.

Moreover, based on the error diffusion method used by the error diffusion unit 1121, d3 is expressed as follows.

$$d3=(E2-d2)\times 7/16+E3 \quad \text{(Equation 1)}$$

Based on the predetermined thinning method used by the thinning unit 1122 and the predetermined interpolation method used by the interpolation unit 1132, d2 is expressed as follows $$d2=(d1+d3)/2 \quad \text{(Equation 2)}$$

Solving (Equation 1) and (Equation 2) for d2 and d3 as a simultaneous equation in which d2 and d3 are variables yields (Equation 3) and (Equation 4) below.

$$d3=(-7/32\times d1+7/16\times E2+E3)/(1+7/32) \quad \text{(Equation 3)}$$

$$d2=d1/2+(-7/32\times d1+7/16\times E2+E3)/(2+7/16) \quad \text{(Equation 4)}$$

(Equation 3) and (Equation 4) show that d2 and d3 are uniquely defined by known values.

Accordingly, when the error diffusion method performed by the error diffusion unit 1121 is the predetermined error diffusion method described above, the thinning method performed by the thinning unit 1122 is the predefined thinning method described above, the interpolation method performed by the interpolation unit 1132 is the predefined interpolation method described above, the error diffusion unit 1121 performs error diffusion transform that makes the error value for i2 be d2−i2 such that d2 is a value expressed by (Equation 4), and d3 is a value expressed by (Equation 3) in order to perform error diffusion transform that makes the fourth correction data and the second correction data match.

FIG. 11A illustrates the data configuration of one example of the first correction data. FIG. 11B illustrates the data configuration of error values propagated from the above row when the above-described error diffusion transform is performed on the first correction data illustrated in FIG. 11A by the error diffusion unit 1121. FIG. 11C illustrates the data configuration of the second correction data generated as a result of the above-described error diffusion transform being performed on the first correction data illustrated in FIG. 11A by the error diffusion unit 1121. FIG. 11D illustrates the data configuration of the third correction data generated as a result of the above-described thinning transform being performed on the second correction data illustrated in FIG. 11C by the thinning unit 1122. FIG. 11E illustrates the data configuration of the fourth correction data generated as a result of the above-described interpolation transform being performed on the third correction data illustrated in FIG. 11D by the interpolation unit 1132.

As illustrated in FIG. 11C and FIG. 11D, the second correction data and the fourth correction data match.

Note that here, the pixels that are candidates for error diffusion and thinning are exemplified as being nonconsecutive pixels in the direction of the rows in the matrix of the pixels 400, but the pixels that are candidates the error diffusion and thinning may be consecutive pixels in the direction of the rows in the matrix of the pixels 400.

Even when the pixels that are candidates for error diffusion and thinning are consecutive pixels in the direction of the rows in the matrix of the pixels 400, the same calculations used for when the pixels are nonconsecutive in the direction of the rows are used.

Next, returning to FIG. 9, description of the controller 10B will continue.

The luminance signal correction unit 1131 multiplies (or divides) the gain correction value of the fourth correction data and adds (or subtracts) the offset correction value of the fourth correction data with the pre-correction luminance signal to correct the pre-correction luminance signal.

The memory 11 stores the third correction data generated by the transform unit 12B applying a transform to the first correction data. The third correction data is smaller in data size than the first correction data.

With the display device 5 configured as described above, the data size of the third correction data stored in the memory 11 is reduced to about ½ the size of the first correction data compared to when the first correction data is stored as-is. This results in the advantageous effect that the capacity of the memory 11 that stores the third correction data reduced in data size by the transform unit 12B can be reduced when the resolution of the display 40 is increased. Since there is no need to have an excessively large capacity and long lifespan for the storage medium, for example, non-volatile memory, such as flash memory, can be used as the memory 11.

Figure 12:
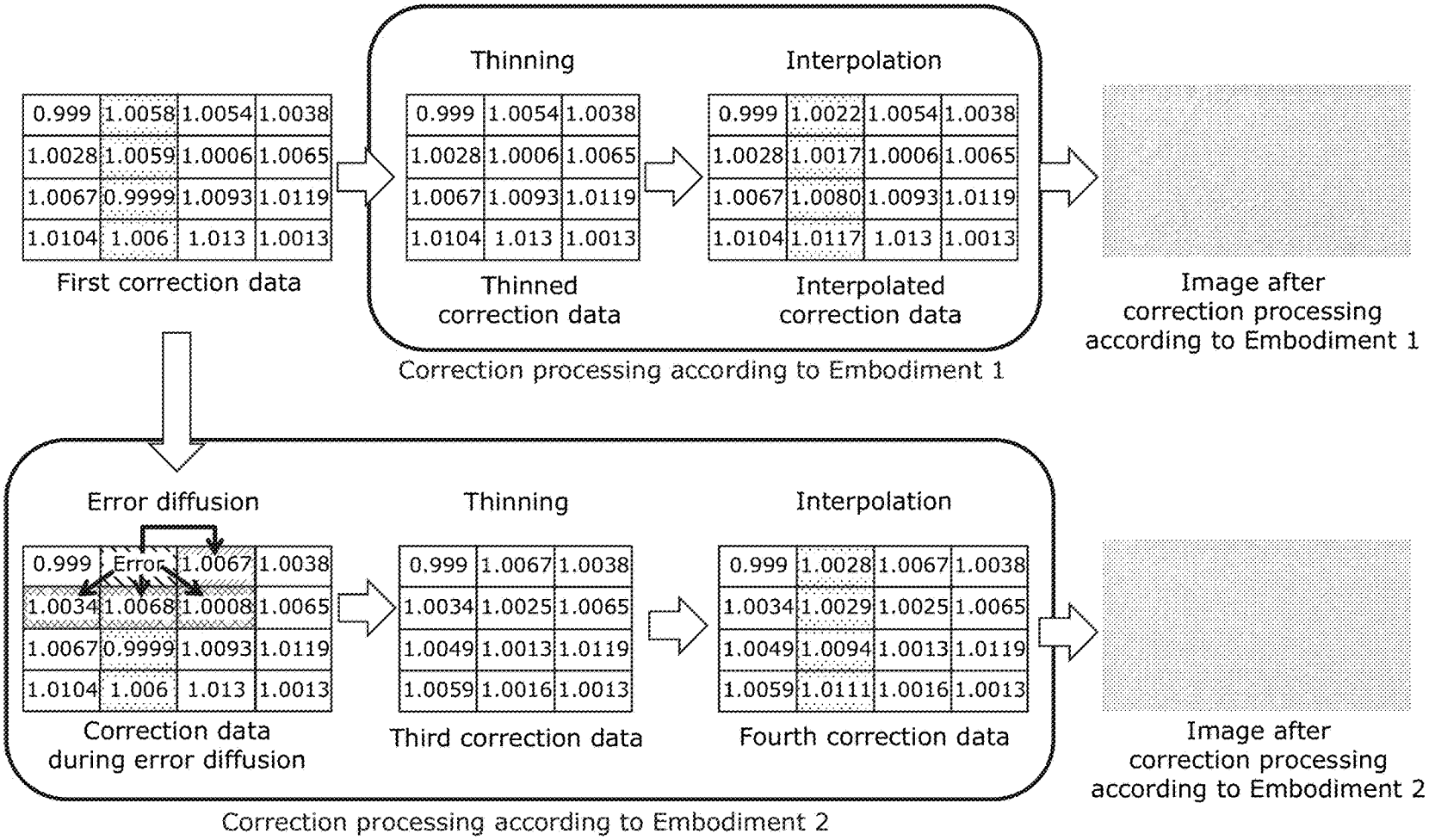
FIG. 12 illustrates a comparison of correction processes and the results thereof between the display device according to Embodiment 1 and the display device according to Embodiment 2.

FIG. 12 illustrates a comparison of correction processes and the results thereof between the display device 1 according to Embodiment 1 and the display device 5 according to Embodiment 2.

As illustrated in FIG. 12, compared to the image illustrating the results of the correction processes performed by the display device 1 according to Embodiment 1, the image illustrating the results of the correction processes performed by the display device 5 according to Embodiment 2 is less uneven in regard to luminance. This is because, whereas in the display device 1 according to the Embodiment 1, the interpolated correction data interpolated by the interpolation unit 132 is not an accurate reproduction of the removed correction data removed by the thinning unit 121, in the display device 5 according to the Embodiment 2, the fourth correction data applied with an interpolation transform by the interpolation unit 1132 is an accurate reproduction of the second correction data generated by the error diffusion unit 1121 applying an error diffusion transform on the first correction data.

Thus, with the display device 5 according to Embodiment 2, even if the number of pixels in the display is increased, the precision of the luminance correction can be maintained and the correction data size and data transfer rate can be reduced.

Note that in the display device 5 according to Embodiment 2, the transform unit 12B and the correction unit 13B may be realized as integrated circuits (IC) or large scale integrated (LSI) circuits. Moreover, the method of integration may be a dedicated circuit or a generic processor. A Field Programmable Gate Array (FPGA) or a reconfigurable processor that allows reconfiguration of the connection or configuration of the inner circuit cells of the LSI circuit can be used for the same purpose. Further, if integrated circuit technology that replaces LSI is newly created from advances in or derivations of semiconductor technology, integration of functional blocks using such technology may also be used. Moreover, the transform unit 12B and the correction unit 13B may be realized as a program that executes the above-described encoding and decoding processing, and may be realized as a computer-readable non-transitory recording medium storing such a program. Examples of the computer-readable non-transitory recording medium include flexible disk, hard disk, CD-ROM, MO, DVD, DVD-ROM, DVD-RAM, Blu-Ray™ (BR) disc, and semiconductor memory. It goes without saying that such a program can be distributed via a recordable medium such as a CD-ROM or over a transmission medium such as the Internet.

(2.3 Display Device Correction Method)

Next, the correction method performed by the display device 5 according to this embodiment will be described.

Figure 13:
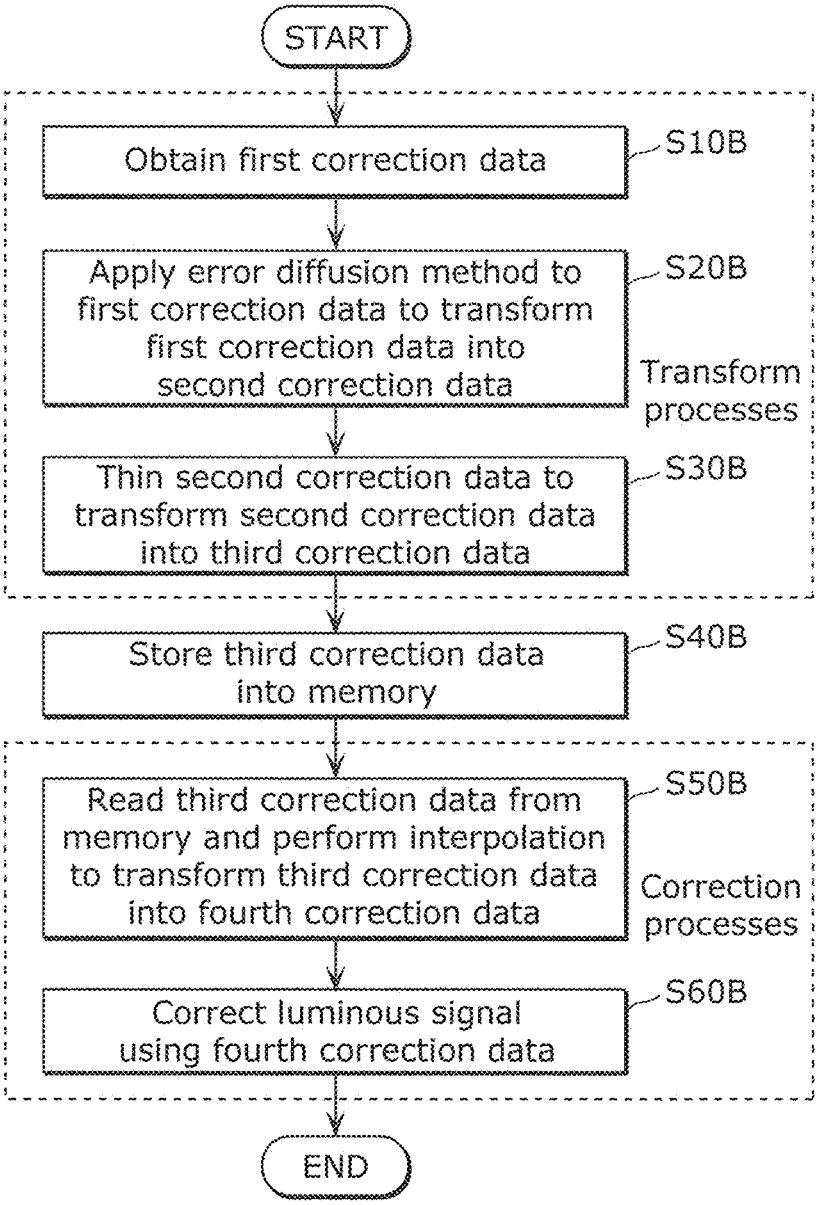
FIG. 13 is an operational flow chart illustrating the correction method used by the display device according to Embodiment 2.

FIG. 13 is an operational flow chart illustrating the correction method performed by the display device 5 according to Embodiment 2.

Hereinafter, the correction steps will be described with reference to FIG. 13.

As illustrated in FIG. 13, the correction method performed by the display device 5 differs from the correction method performed by the display device 1 according to Embodiment 1 (see FIG. 6) in that the step S10 is step S10B, step S20 is step S20B, step S30 is step S30B, step S40 is step S40B, step S50 is step S50B, and step S60 is step S603.

Here, step S10B is the same as step S10 according to Embodiment 1 if display device 1 is read as display device 5 and controller 10 is read as controller 10B. Therefore, the following description will focus on steps S20B, S30B, S40B, S50B, and S60B.

After completion of step S10B, the controller 10B applies an error diffusion method of diffusing an error component of at least one of the correction data components included in the first correction data to neighboring pixels of the correction data components to transform the first correction data into second correction data (S20B). Step S20B is a first transform step performed by the error diffusion unit 1121. Here, in the first transform step, based on the predetermined thinning method and the predetermined interpolation method, the above-described transform is performed such that the second correction data and the fourth correction data match Next, the controller 10B thins the correction data components included in the second correction data by removing at least one but not all of the correction data components using a predetermined thinning method to transform the second correction data into third correction data smaller in data size than the first correction data (S30B). Step S30B is a second transform step performed by the thinning unit 1122.

Next, the controller 10B stores, in advance, the third correction data in the memory 11 included in the display device 5 (S40B; storing step).

Next, the controller 10B reads the second correction data from the memory 11 and uses pixel data components included in the third correction data to transform the third correction data into fourth correction data including a plurality of correction data components corresponding to the pixels by interpolation using a predetermined interpolation method (S50B). Step S50B is a third transform step performed by the interpolation unit 1132.

Next, the controller 10B corrects the luminance signal using the above-described fourth correction data (S60B; correction step).

Embodiment 3

In Embodiment 2, a correction method performed by the display device 5 in which the first correction data is obtained, the second correction data, the third correction data, and the fourth correction data are generated from the first correction data, and the luminance signal is corrected using the fourth correction data is described. In contrast, in this embodiment, a manufacturing method for the display device 5 in which the second correction data and the third correction data are generated from the first correction data and the third correction data is stored in the memory 11 of the display device 5 will be described. In other words, the manufacturing method for the display device 5 according to this embodiment differs from the correction method performed by the display device 5 according to Embodiment 2, which includes steps up to the correction of the luminance signal using the fourth correction data, in that it includes steps up to the storing of the third correction data into the memory 11. In the following description, configurations that are the same as in display device 5 according to Embodiment 2 and the correction method performed thereby will be omitted. The description will focus on the points of difference.

(3.1 Information Processing Device Configuration in Manufacturing Steps)

Figure 14:
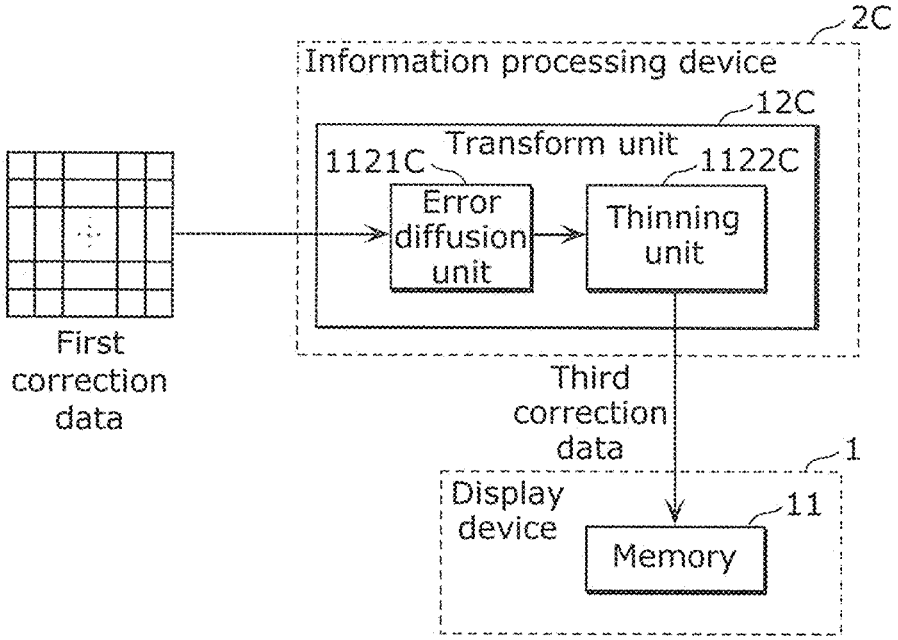
FIG. 14 is a block diagram illustrating the configuration of an information processing device for obtaining second correction data in a manufacturing step.

FIG. 14 is a block diagram illustrating the configuration of an information processing device 2C for obtaining the second correction data in a manufacturing step. The information processing device 2C illustrated in FIG. 14 is a device used in a manufacturing step for the display device 5, and includes a transform unit 12C.

The transform unit 12C includes an error diffusion unit 1121C and a thinning unit 1122C.

The error diffusion unit 1121C has the same functions as the error diffusion unit 1121 according to Embodiment 2. In other words, the error diffusion unit 1121C transforms the first correction data into the second correction data.

The thinning unit 1122C has the same functions as the thinning unit 1122 according to Embodiment 2. In other words, the thinning unit 1122C transforms the second correction data into the third correction data.

Note that the first correction data may be obtained by the information processing device 2 according to Embodiment 1 illustrated in FIG. 7. Here, the information processing device 2 according to Embodiment 1 and the information processing device 2C according to this embodiment may be a single device that includes both functions. In other words, the information processing device 2C according to this embodiment may include, in addition to the transform unit 12C, the computing unit 201, the storage 202, and the communication unit 203. Moreover, the first correction data may be applied in advance to the information processing device 2C.

(3.2 Display Device Manufacturing Method)

Figure 15:
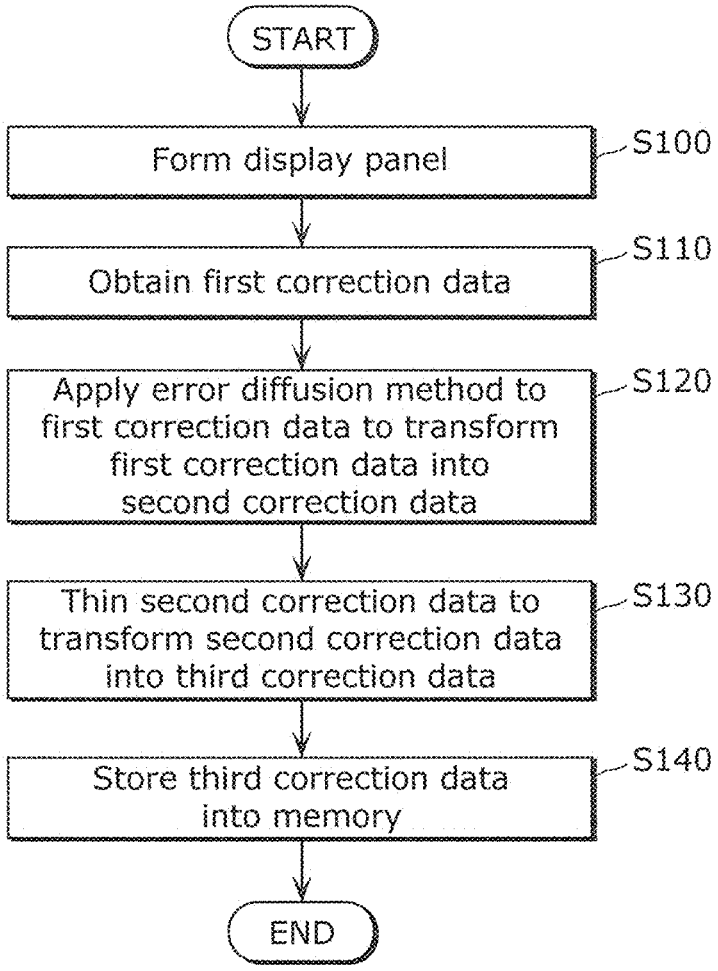
FIG. 15 is an operational flow chart illustrating the manufacturing method for the display device according to Embodiment 3.

FIG. 15 is an operational flow chart illustrating the manufacturing method for the display device 5 according to Embodiment 3. In FIG. 15, steps from the forming of the display panel included in the display device 5 to the storing of the third correction data in the memory are illustrated. Hereinafter, the manufacturing steps will be described with reference to FIG. 15.

First, the display panel included in the display device 5 is formed (S100; forming step). Hereinafter, an example of a display panel forming step will be given. For example, a planarizing film made of an organic, electrically insulating material, is formed on a substrate including circuit components such as a TFT, and then an anode is formed on the planarizing film. Next, for example, a hole-injection layer is formed on the anode. Next, a light emitting layer is formed on the hole-injection layer. Next, an electron-injection layer is formed on the light emitting layer. Next, a cathode is formed on the substrate on which the electron-injection layer is formed. With these steps, an organic EL element having the function of a light emitting element is formed. Furthermore, a thin film sealing layer is formed on the cathode. Next, a sealant resin layer is formed on the surface of the thin film sealing layer. Then, a color filter is formed on the applied sealant resin layer. Next, an adhesive layer and a transparent substrate are arranged on the color filter. Note that the thin film sealing layer, the sealant resin layer, the adhesive layer, and the transparent substrate collectively correspond to the protective layer. Lastly, the sealant resin layer is hardened by compressing the transparent substrate from the top surface downward and applying heat or by applying an energy line, and the transparent substrate, the adhesive layer, the color filter, and the thin film sealing layer are adhered together. The display panel is formed by these forming steps.

Next, the information processing device 2C obtains, in advance, the first correction data (unprocessed correction data) for correcting the luminance signal for causing the organic EL elements 401 to emit light at a predetermined luminance (S110; obtaining step). As previously described, the first correction data (unprocessed correction data) includes, for example, two correction parameters: a gain correction value and an offset correction value, which correspond to a pixel 400. The first correction parameters may be obtained by the information processing device 2 according to Embodiment 1 illustrated in FIG. 7, and, alternatively, may be obtained by using the first correction parameters from a display panel manufactured in the same batch, for example.

Next, the information processing device 2C applies an error diffusion method of diffusing an error component of at least one of the correction data components included in the first correction data to neighboring pixels of the correction data components to transform the first correction data into second correction data (S120).

Next, the information processing device 2C thins the correction data components included in the second correction data by removing at least one but not all of the correction data components using a predetermined thinning method to transform the second correction data into third correction data smaller in data size than the first correction data (S130).

Next, the information processing device 2C stores the third correction data in the memory 11 included in the display device 5 (S140; storing step).

With the above-described manufacturing method for the display device 5 according this embodiment, the data size of the third correction data stored in the memory 11 is reduced to about ½ the size of the first correction data compared to when the first correction data is stored as-is. This results in the advantageous effect that the capacity of the memory 11 that stores the third correction data reduced in data size by the transform unit 12C can be reduced when the resolution of the display 40 is increased.

Note that the information processing device 2C may include therein the controller 10B that is included in the display device 5, and in a manufacturing process, the controller 10B may obtain the second correction data and store the second correction data in the memory 11.

Embodiment 4

In Embodiment 2, a correction method performed by the display device 5 in which the first correction data is obtained, the second correction data, the third correction data, and the fourth correction data are generated from the first correction data, and the luminance signal is corrected using the fourth correction data is described. In contrast, in this embodiment, a display method for the display device 5 including reading the third correction data, correcting the luminance signal using the third correction data, and displaying an image based on the corrected luminance signal will be described. In other words, the display method for the display device 5 according to this embodiment differs from the manufacturing method for the display device 5 according to Embodiment 3, which includes steps up to the storing of the second correction data into the memory 11, in that it includes steps from the reading of the stored third correction data to the displaying of an image. In the following description, configurations that are the same as in display device 5 according to Embodiment 2 and the correction method performed thereby will be omitted. The description will focus on the points of difference.

(4.1 Controller Configuration)

Figure 16:
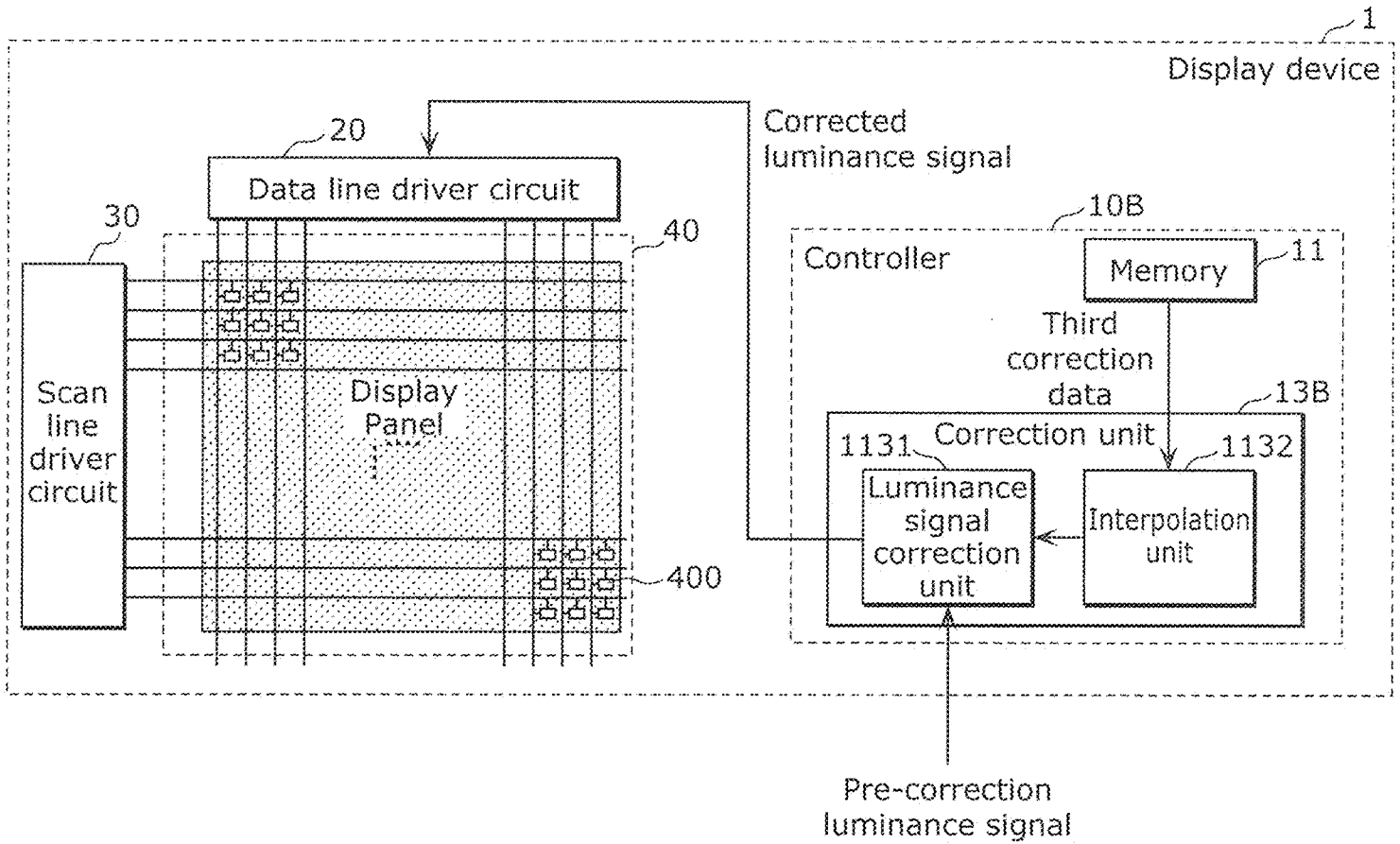
FIG. 16 is a block diagram illustrating a configuration of the controller that causes the display device to correct and display a luminance signal using the third correction data according to Embodiment 4.

FIG. 16 is a block diagram illustrating a configuration of the controller 10B in the display device 5 that corrects the luminance signal using the third correction data and displays the corrected luminance signal. The controller 10B illustrated in FIG. 16 includes the memory 11 and the correction unit 13B.

The controller 10B, the memory 11, and the correction unit 13B have already been described in Embodiment 1 and Embodiment 2. Accordingly, repeated description thereof is omitted below.

(4.2 Display Device Display Method)

Figure 17:
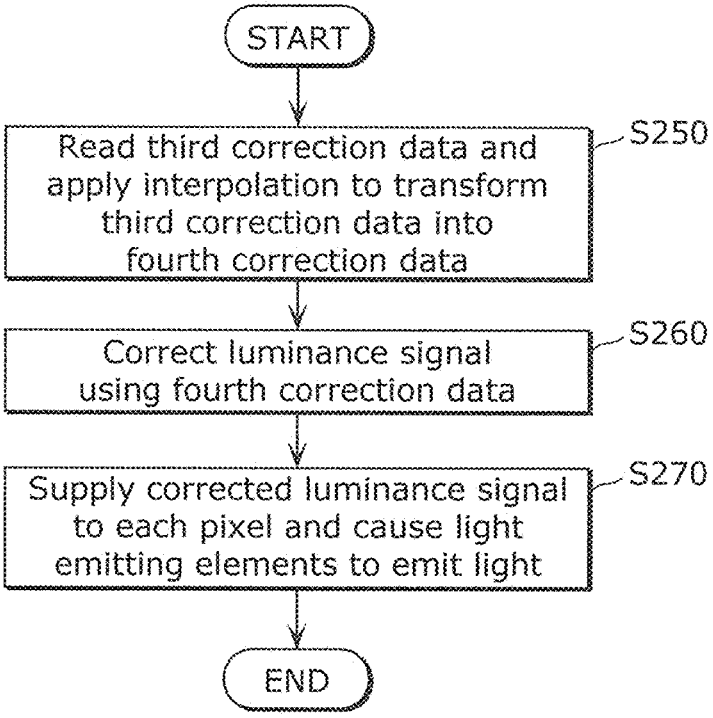
FIG. 17 is an operational flow chart illustrating the display method for the display device according to Embodiment 4.

FIG. 17 is an operational flow chart illustrating the display method for the display device 5 according to Embodiment 4, FIG. 17 illustrates steps performed by the controller 10B included in the display device 5, from reading the third correction data to correcting the luminance signal and displaying an image. Hereinafter, the correction steps will be described with reference to FIG. 17.

First, the controller 10B reads the third correction data from the memory 11 and uses pixel data components included in the third correction data to transform the third correction data into fourth correction data including a plurality of correction data components corresponding to the pixels by interpolation using a predetermined interpolation method (S250B).

Next, the controller 10B corrects the luminance signal using the fourth correction data (S260; correction step).

Lastly, the controller 10B supplies the luminance signal corrected in the above correction step to each pixel 400, and causes the display 40 to display an image by causing the organic EL elements 401 to emit light in accordance with the luminance signal (S270; display step).

Other Embodiments

The display device, the correction method for the display device, the manufacturing method for the display device, and the display method for the display device have been described based on, but are not limited to, the exemplary Embodiments 1 through 4. Those skilled in the art will readily appreciate that many modifications are possible in the exemplary embodiments without materially departing from the inventive scope. Accordingly, all such modifications, including any device including the display device according to the present disclosure are intended to be included within the scope thereof.

Figure 18:
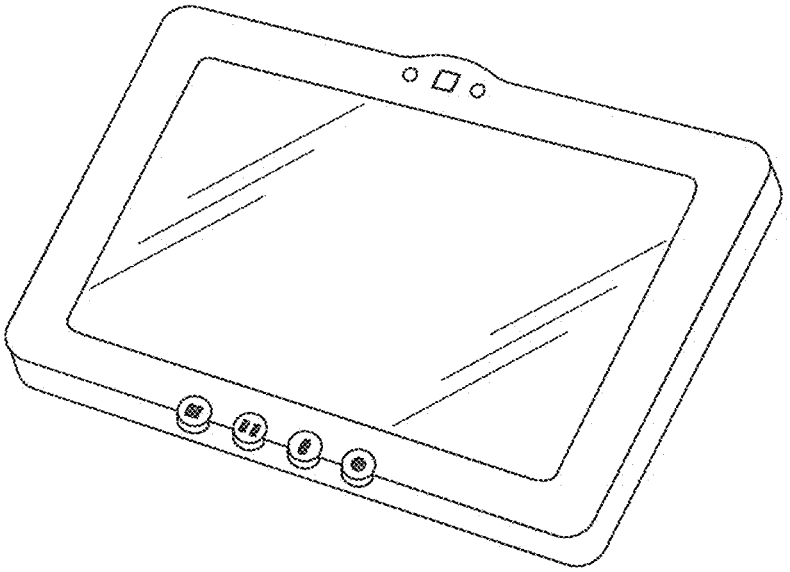
FIG. 18 is an external view of a tablet terminal internally equipped with the display device according to any one of Embodiments 1 to 4.

For example, the display device, the correction method for the display device, the manufacturing method for the display device, and the display method for the display device according to Embodiments 1 to 4 are applied to a tablet like the one illustrated in FIG. 18. Through application of the display device, the correction method for the display device, the manufacturing method for the display device, and the display method for the display device according to the present disclosure, a compact, high-definition, low-cost tablet including a display with reduced luminance unevenness is realized.

Note that in the above embodiments, an image is displayed on the display 40 based on a luminance signal generated based on an external video signal, but this example is not limiting. A luminance signal for causing the pixels to emit light is not limited to being generated from an external video signal; the luminance signal may be generated from various types of signals for displaying still or moving pictures.

Moreover, the first correction data is not limited to being generated during manufacturing of the display device. Moreover, the third correction data is not limited to being stored in the memory 11 generated during manufacturing of the display device. After manufacturing of the display device is complete, while the display device is operating or not operating, the first correction data may be updated and the third correction data may be newly stored based on the updated first correction data.

Moreover, the light emitting elements included in the pixels are not limited to organic EL elements. The light emitting elements may be made of a current-driven or voltage-driven inorganic material.

INDUSTRIAL APPLICABILITY

The present disclosure is applicable to organic EL flat panel displays having a display device including organic EL elements, and is optimal for a compact, high-definition display device in which uniform image quality is desirable, and a correction method therefore.

The invention claimed is:

1. A display device correction method for correcting luminance unevenness in a display device including a matrix of pixels each including a light emitting element that emits light in accordance with a luminance signal, the display device correction method comprising:

obtaining, in advance, first correction data for correcting the luminance signal, the first correction data including correction data components corresponding to the pixels;

performing a first transform including applying an error diffusion method to at least one of the correction data components included in the first correction data to transform the first correction data into second correction data including correction data components corresponding to the pixels, the error diffusion method including diffusing an error component of a current correction data component among the at least one of the correction data components to a correction data component corresponding to a neighboring pixel of a pixel corresponding to the current correction data component;

performing a second transform including thinning, via a predetermined thinning method, the correction data components included in the second correction data by removing at least one but not all of the correction data components to transform the second correction data into third correction data smaller in data size than the first correction data;

performing a third transform including interpolation, via a predetermined interpolation method, using pixel data components included in the third correction data to transform the third correction data into fourth correction data including correction data components corresponding to the pixels; and correcting the luminance signal using the fourth correction data, wherein, in the performing of the first transform, based on the predetermined thinning method and the predetermined interpolation method, the transform is performed such that the second correction data and the fourth correction data match.

2. The display device correction method according to claim 1, wherein at least one of the correction data components included in the second correction data that corresponds to the at least one of the correction data components included in the first correction data is a candidate for removal in the thinning performed in the performing of the second transform, and the error component is a difference between a value of a correction data component included in the first correction data that is a candidate for application of the error diffusion method and a value of a corresponding correction data component included in the fourth correction data.

3. The display device correction method according to claim 1, wherein the predetermined interpolation method is linear interpolation performed for each removed correction data component removed in the performing of the second transform, by using correction data components that correspond to two pixels, the two pixels being in a same row, in the matrix of the pixels, as a target pixel corresponding to a current removed correction data component among the removed correction data components, a first of the two pixels being a pixel that is not a candidate for removal in the thinning that is positioned left of and closest to the target pixel, a second of the two pixels being a pixel that is not a candidate for removal in the thinning that is positioned right of and closest to the target pixel.

4. The display device correction method according to claim 1, wherein the predetermined thinning method is a method of removing correction data components corresponding to pixels in a predetermined column in the matrix of the pixels.

5. The display device correction method according to claim 4, wherein the predetermined column comprises even-numbered columns in the matrix.

6. A display device manufacturing method for manufacturing a display device including a matrix of pixels each including a light emitting element that emits light in accordance with a luminance signal, the display device manufacturing method comprising:

obtaining, in advance, first correction data for correcting the luminance signal, the first correction data including correction data components corresponding to the pixels;

performing a first transform including applying an error diffusion method to at least one of the correction data components included in the first correction data to transform the first correction data into second correction data including correction data components corresponding to the pixels, the error diffusion method including diffusing an error component of a current correction data component among the at least one of the correction data components to a correction data component corresponding to a neighboring pixel of a pixel corresponding to the current correction data component;

performing a second transform including thinning, via a predetermined thinning method, the correction data components included in the second correction data by removing at least one but not all of the correction data components to transform the second correction data into third correction data smaller in data size than the first correction data; and storing the third correction data in memory included in the display device, wherein fourth correction data is derived by interpolation, via a predetermined interpolation method, performed on the third correction data, using pixel data components included in the third correction data, and in the performing of the first transform, the transform is performed based on the predetermined thinning method and the predetermined interpolation method such that the second correction data and the fourth correction data match.

7. A display device display method for a display device including a matrix of pixels each including a light emitting element that emits light in accordance with a luminance signal, the display device display method comprising:

performing a third transform including interpolation, via a predetermined interpolation method, using pixel data components included in third correction data to transform the third correction data into fourth correction data including correction data components corresponding to the pixels, the third correction data being derived by (i) obtaining, in advance, first correction data for correcting the luminance signal, the first correction data including correction data components corresponding to the pixels, (ii) performing a first transform including applying an error diffusion method to at least one of the correction data components included in the first correction data to transform the first correction data into second correction data including correction data components corresponding to the pixels, the error diffusion method including diffusing an error component of a current correction data component among the at least one of the correction data components to a correction data component corresponding to a neighboring pixel of a pixel corresponding to the current correction data component, and (ii) performing a second transform including thinning, via a predetermined thinning method, the correction data components included in the second correction data by removing at least one but not all of the correction data components to transform the second correction data into third correction data smaller in data size than the first correction data; and correcting the luminance signal using the fourth correction data, wherein, in the performing of the first transform, based on the predetermined thinning method and the predetermined interpolation method, the transform is performed such that the second correction data and the fourth correction data match.

8. A display device including a matrix of pixels each including a light emitting element that emits light in accordance with a luminance signal, the display device comprising:

an error diffusion unit configured to apply an error diffusion method to at least one of correction data components that are included in first correction data and correspond to the pixels, to transform the first correction data into second correction data including correction data components corresponding to the pixels, the error diffusion method including diffusing an error component of a current correction data component among the at least one of the correction data components to a correction data component corresponding to a neighboring pixel of a pixel corresponding to the current correction data component, the first correction data being for correcting the luminance signal;

a thinning unit configured to thin, via a predetermined thinning method, the correction data components included in the second correction data by removing at least one but not all of the correction data components to transform the second correction data into third correction data smaller in data size than the first correction data;

an interpolation unit configured to perform interpolation, via a predetermined interpolation method, using pixel data components included in the third correction data to transform the third correction data into fourth correction data including correction data components corresponding to the pixels; and a luminance signal correction unit configured to correct the luminance signal using the fourth correction data, wherein the error diffusion unit is configured to transform the first correction data into the second correction data based on the predetermined thinning method and the predetermined interpolation method such that the second correction data and the fourth correction data match.

9. A display device including a matrix of pixels each including a light emitting element that emits light in accordance with a luminance signal, the display device comprising:

an interpolation unit configured to perform interpolation, via a predetermined interpolation method, using pixel data components included in third correction data to transform the third correction data into fourth correction data including correction data components corresponding to the pixels, the third correction data being derived by (i) obtaining, in advance, first correction data for correcting the luminance signal, the first correction data including correction data components corresponding to the pixels, (ii) performing a first transform including applying an error diffusion method to at least one of the correction data components included in the first correction data to transform the first correction data into second correction data including correction data components corresponding to the pixels, the error diffusion method including diffusing an error component of a current correction data component among the at least one of the correction data components to a correction data component corresponding to a neighboring pixel of a pixel corresponding to the current correction data component, and (ii) performing a second transform including thinning, via a predetermined thinning method, the correction data components included in the second correction data by removing at least one but not all of the correction data components to transform the second correction data into third correction data smaller in data size than the first correction data; and a luminance signal correction unit configured to correct the luminance signal using the fourth correction data, wherein, in the performing of the first transform, based on the predetermined thinning method and the predetermined interpolation method, the transform is performed such that the second correction data and the fourth correction data match.

* * * * *